US006540576B1

(12) United States Patent
Watanabe et al.

(10) Patent No.: US 6,540,576 B1
(45) Date of Patent: Apr. 1, 2003

(54) PLASMA DISPLAY PANEL AND METHOD OF MANUFACTURING THE SAME

(75) Inventors: Taku Watanabe, Osaka (JP); Yuusuke Takada, Katano (JP); Shigeo Suzuki, Hirakata (JP); Masaki Aoki, Mino (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/529,612

(22) PCT Filed: Oct. 16, 1998

(86) PCT No.: PCT/JP98/04679

§ 371 (c)(1),
(2), (4) Date: Jun. 26, 2000

(87) PCT Pub. No.: WO99/21208

PCT Pub. Date: Apr. 29, 1999

(30) Foreign Application Priority Data

Oct. 16, 1997 (JP) ..... 9-283331

(51) Int. Cl.[7] ..... H01J 9/24
(52) U.S. Cl. ..... 445/24
(58) Field of Search ..... 445/24

(56) References Cited

U.S. PATENT DOCUMENTS 5,730,637 A * 3/1998 Suzuki et al. ..... 445/49
6,160,345 A * 12/2000 Tanaka et al. ..... 313/489

FOREIGN PATENT DOCUMENTS

| | | |
|---|---|---|
| JP | 06150830 | 5/1994 |
| JP | 08212918 | 8/1996 |
| JP | 08304787 | 11/1996 |
| JP | 08315740 | 11/1996 |
| JP | 08329843 | 12/1996 |
| JP | 10334812 | 12/1998 |

OTHER PUBLICATIONS

International Search Report, International Application No. PCT/JP98/04679, dated Feb. 2, 1999.

* cited by examiner

*Primary Examiner*—Kenneth J. Ramsey
(74) *Attorney, Agent, or Firm*—Renner, Otto, Boisselle & Sklar

(57) ABSTRACT

In a plasma display panel, a partition wall defining a discharge space is formed of a thermal-sprayed film formed by thermal spraying of a partition wall material. A process for forming such a partition wall includes the steps of forming a photosensitive coating layer on a substrate; forming an opening having a prescribed pattern in the photosensitive coating layer; depositing the partition wall material to a prescribed height at least inside the opening by a thermal spraying technique, thereby forming the thermal-sprayed film; removing a portion of the thermal-sprayed film bulging out from a surface of the photosensitive coating layer by polishing; and removing the photosensitive coating layer to obtain the partition wall having a prescribed shape.

9 Claims, 18 Drawing Sheets

PLASMA DISPLAY PANEL AND METHOD OF MANUFACTURING THE SAME

TECHNICAL FIELD

The present invention relates to a plasma display panel used for display devices and the like and a method for producing the same, and more specifically to a plasma display panel having a partition wall formed by a thermal spraying technique and a method for producing the same, especially a process for forming a partition wall by the thermal spraying technique.

BACKGROUND ART

A plasma display panel, which has recently been a target of attention as being suitable for a thin display device, has, for example, a structure shown in FIG. 1. The plasma display device shown in FIG. 1 includes a front substrate 300 and a rear substrate 301 which are located to face each other. Display electrodes 302 and 303, a dielectric layer 304, and a MgO dielectric protective layer 305 are sequentially formed on the front substrate 300. An address electrode 306 and a dielectric layer 307 are formed on the rear substrate 301, and partition walls 308 are formed thereon. A fluorescent layer 309 is applied to a side surface of each partition wall 308.

Discharge gas 310 (for example, a Ne-Xe mixture gas) is sealed between the front substrate 300 and the rear substrate 301 at a pressure of 500 to 600 Torr. The discharge gas 310 is discharged between the display electrodes 302 and 303 to generate ultraviolet rays, and the fluorescent layer 309 is irradiated with the ultraviolet rays to realize image display including color image display.

The partition walls 308 are provided for forming a microscopic discharge space for each of pixel element colors (G, B, R), thus to form discharge cells. The partition walls 308 allow discharge to be controlled on a cell-by-cell basis. Thus, erroneous discharge and erroneous display can be prevented. The sizes of the partition walls 308 are typically as follows in a 40-inch NTSC panel: the partition wall pitch per color is 360 $\mu$m; the width of a top end of the partition wall is 50 $\mu$m to 100 $\mu$m; and the height of the partition wall is 100 $\mu$m to 150 $\mu$m.

Conventional methods for forming a partition wall include (1) a printing technique, (2) a sand-blasting technique, (3) a photo-pasting technique, and (4) a photo-burying technique (or a lift-off technique). By the printing technique, the partition wall is formed using a screen printing technology. By the sand-blasting technique, a partition wall material is applied on the entire surface of the rear substrate, then a photosensitive film layer is formed on the partition wall material to form a prescribed pattern by a photography technique. An unnecessary portion of the partition wall material is removed by sand-blasting to remove the photosensitive film layer, thereby forming the partition wall. By the photo-pasting technique, a photosensitive paste is applied, and then an unnecessary portion is removed by a photography technique to form the partition wall. By the photo-burying technique (or a lift-off technique), a photosensitive film layer is formed on a substrate, and then a prescribed pattern is formed by a photography technique. A paste is buried in a groove of the pattern, the photosensitive film layer is removed, and then the paste is solidified by baking.

However, these conventional methods have the following problems.

By the printing technique, a partition wall having a height of only about 10 $\mu$m can be formed by one cycle of printing. Thus, the printing cycle and the drying cycle need to be repeated in order to form a partition wall having a height of about 100 $\mu$m. Such a repetition increases the number of steps and raises the cost. Moreover, as the screen becomes larger, the non-linear expansion and contraction of the screen plate becomes conspicuous, which results in a larger dispersion in the position, thickness and shape of the partition walls.

The sand-blasting technique has the problems that a large amount of material needs to be removed, and that the amount of the material to be removed is difficult to be controlled and thus the substrate and the electrodes are likely to be damaged. The photo-pasting technique has the problem of the expensive pasting material. The photo-burying technique realizes a high precision plasma display panel but cannot realize low-cost production due to the baking step required for forming the partition wall.

DISCLOSURE OF THE INVENTION

The invention described herein made for overcoming the above-described problems of the conventional art makes possible the advantages of (1) providing a method for producing a plasma display panel realizing high quality display by forming a partition wall by a thermal spraying technique at a high precision at low cost; and (2) providing a plasma display panel which has a partition wall produced at a high precision at low cost and thus can realize high quality display.

According to a plasma display panel of the present invention, a partition wall for defining a discharge space is formed of a thermal-sprayed film formed by thermal spraying of a partition wall material. Thus, the above-described objectives are achieved.

In one embodiment, the plasma display panel includes a pair of substrates; and an electrode, a dieleetric layer and a fluorescent layer located between the pair of substrates. The partition wall is located between the pair of substrates. A gas medium is a sealed in the discharge space, and ultraviolet rays generated by discharge of the gas medium are converted into visible light when the fluorescent layer is irradiated, and thus the plasma display panel is lit.

The partition wall may be formed of a partition wall material of a first color from a bottom thereof to a prescribed height and is formed of a partition wall material of a second color from the prescribed height to a top end of the partition wall. For example, the first color is white and the second color is black. The partition wall material of the first color may be aluminum oxide or spinel and the partition wall material of the second color may be chromium oxide, titanium oxide, or a mixture or a melt of aluminum oxide and titanium oxide.

The thermal spraying may be plasma thermal spraying.

A method for producing a plasma display panel according to the present invention includes a partition wall formation process of forming a partition wall defining a discharge space of a thermal-sprayed film formed by thermal spraying of a partition wall material. Thus, the above-described objectives are achieved.

In one embodiment, the partition wall formation process includes the steps of forming a photosensitive coating layer on a substrate; forming an opening having a prescribed pattern in the photosensitive coating layer; depositing the partition wall material to a prescribed height at least inside the opening by the thermal spraying technique, thereby forming the thermal-sprayed film; removing a portion of the thermal-sprayed film bulging out from a surface of the photosensitive coating layer by polishing; and removing the photosensitive coating layer to obtain the partition wall having a prescribed shape.

The thermal spraying may be plasma thermal spraying.

In one embodiment the opening having a prescribed pattern formed on the photosensitive coating layer has a trapezoidal cross-section in which a bottom end is wider than a top end, and the base angle of the cross-section is 60 degrees or more and less than 90 degrees.

A width of the top end of the opening having the prescribed pattern formed on the photosensitive coating layer may be 100 $\mu$m or less.

In one embodiment, the partition wall has a multiple-layer structure including at least a first layer formed by depositing a first partition wall material at a plasma energy quantity A and a second layer formed by depositing a second partition wall material on the first layer to a prescribed height at a plasma energy quantity smaller than the plasma energy quantity A, where A is the plasma energy quantity at the time of thermal spraying in an area where at least thermal spray particles tightly adhere to the substrate.

The thermal spraying may be plasma thermal spraying which is performed using at least argon gas or a mixture gas of argon gas and helium gas as plasma operating gas.

In the case where the plasma operating gas is the mixture gas of argon gas and helium gas, the plasma energy quantity may be changed by changing the amount of helium gas.

Preferably, where the width of the top end of the opening having the prescribed pattern formed on the photosensitive coating layer is Wa, a primary particle diameter D of powder of the partition wall material is in the range of 5 $\mu$m or more and 0.7·Wa or less.

The step of forming the thermal-sprayed film may include the step of removing thermal spray particles adhering to the photosensitive coating layer simultaneously with the deposition of the partition wall material.

The step of forming the thermal-sprayed film may include the stop of heating the substrate from a rear surface thereof to maintain a temperature distribution in the substrate within a prescribed range. Alternatively, the step of forming the thermal-sprayed film may include the step of cooling a surface of the substrate to maintain a temperature distribution in the substrate within a prescribed range. Still alternatively, the step of forming the thermal-sprayed film may include the step of heating the substrate from a rear surface thereof and cooling a surface of the substrate to maintain a temperature distribution in the substrate within a prescribed-range.

Preferably, the step of polishing includes the stop of removing the photosensitive coating layer from the surface thereof to a depth of about 10 $\mu$m.

Preferably, the stop of forming the thermal-sprayed film includes the stop of moving a thermal spraying torch in a direction perpendicular to a longitudinal direction of the partition wall.

The method may further include the step of forming a fluorescent layer after the photosensitive coating layer is removed.

In one embodiment, the method further include the steps of filling a nick in the partition wall with a prescribed paste material; and forming a fluorescent layer by baking after the photosensitive coating layer is removed. The prescribed paste material is cured by baking of the fluorescent layer.

In one embodiment, the partition wall is formed by thermal spraying of a partition wall material of a first color from a bottom end thereof to a prescribed height and is formed by thermal spraying of a partition wall material of a second color from the prescribed height to a top end of the partition wall. For example, the first color is white and the second color is black. The partition wall material of the first color may be aluminum oxide or spinal, and the partition wall material of the second color may be chromium oxide, titanium oxide, or a mixture or a melt of aluminum oxide and titanium oxide.

According to the present invention having the above-described features, a groove having a prescribed pattern is formed in a photosensitive coating layer, a partition wall material is then deposited in the grooves by a thermal spraying technique (for example plasma thermal spraying technique), and then the photosensitive coating layer in removed. In this manner, high precision partition wall formation is realized without requiring baking. Thus, the production cost of the partition wall is reduced. In the case where the bottom portion of the partition wall is formed of a white material and the top portion of the partition wall is formed of a black material, the resultant partition wall can provide a high luminance and a high contrast.

More specifically, according to the present invention, a thermal spraying technique (for example, plasma thermal spraying technique) is used to directly deposit a partition wall material on a substrate for forming a partition wall on the substrate. In this manner, baking is eliminated. As a result, a space for an electric oven and power supply required for baking are eliminated, thus reducing the cost.

In the case where the partition wall is formed of a white material from a bottom end to a certain height, the reflectance of the visible light of the partition wall can be improved. Thus, the utilization factor of visible light generated by discharge of the fluorescent portion applied on a side surface of the partition wall is improved; and as a result, the luminance of the plasma display panel is raised. In the case where the partition wall is formed of a black material from the certain height to a top end, the reflection of external light is suppressed. As a result, the contrast of the plasma display panel is increased.

In the case where aluminum oxide is used as the white material, a high reflectance of the visible light is realized. Thus, the luminance of the plasma display panel is improved. In the case where at least either one of chromium oxide and titanium oxide is used as the black material, a low reflectance of the external light is realized. Thus, the contrast of the plasma display panel is enhanced.

In the case where an opening having a prescribed pattern is formed in a photosensitive coating layer provided on the substrate and then a partition wall material is deposited in the opening by a thermal spraying technique (for example, plasma thermal spraying technique) to form a partition wall, the shape of the partition wall is limited to the shape of the pattern of the opening formed in the photosensitive coating layer. Accordingly, highly precise partition wall formation is realized.

In the case where the cross-section of the opening formed in the photosensitive coating layer is trapezoidal with the bottom end being wider than the top end and where the base angle of the trapezoidal cross-section is 60 degrees or more and less than 90 degrees, the partition wall material fills and is deposited in the opening having the prescribed pattern. Thus, the shape precision of the partition wall and the adhesiveness of the partition wall to the substrate can be made uniform. Furthermore, the removal of the photosensitive coating layer can be facilitated to eliminate nicks in the partition wall. When the width of the top end of the opening in the photosensitive coating layer is 100 μm or less, the adhesive force between the partition wall and the substrate is small. Accordingly, the partition wall may possibly be removed together with the photosensitive coating layer by the force in the direction of the partition wall which is generated when the photosensitive coating layer is removed. However, according to the present invention, even when the width of the top end of the partition wall is small, the force pushing the partition wall can be alleviated and thus the photosensitive coating layer can be removed without removing the partition wall.

The partition wall can have a multiple-layer structure including at least a first layer formed by depositing a first partition wall material at a plasma energy quantity A and a second layer formed by depositing a second partition wall material on the first layer to a prescribed height at a plasma energy quantity smaller than the plasma energy quantity A, where A is the plasma energy quantity at the time of thermal spraying in an area where at least thermal spray particles tightly adhere to the substrate. In this case, the adhesive force between the substrate and the thermal spray particles can be secured, and also the oxygen defect of the second partition wall material (for example, aluminum oxide) can be reduced to guarantee the whiteness of the partition wall material.

Argon, or a mixture gas of argon and helium, can be used as the plasma operating gas, and the plasma energy quantity can be changed by changing the mixed amount of helium. In this case, when a smaller amount of helium is mixed for forming the second layer than for forming the first layer, the second layer can be formed at a smaller plasma energy quantity than that required for forming the first layer.

In the case where the primary particle diameter D of the powder of the partition wall material used for forming the partition wall is set to be 5 μm or more and 0.7·Wa or less where Wa is the top width of the opening, the following effects are provided. When the primary particle diameter D of the powder of the partition wall material is 5 μm or more, the partition wall material can be injected into the plasma jet efficiently. As a result, the utilization factor of the partition wall material for forming the partition wall by the plasma thermal spraying technique can be raised. When the primary particle diameter D of the powder of the partition wall material is 0.7·Wa or less, the opening in the photosensitive coating layer can be efficiently filled with the partition wall material.

When the thermal spray particles adhere to the photosensitive coating layer and a part of the opening (groove) having the prescribed pattern formed in the photosensitive coating layer is covered with the adhering particles, the thermal spray particles are prevented from being deposited in that part, which causes a nick in the partition wall. In order to avoid this, a removing mechanism having a prescribed shape, for example, a squeegee having a sharp end in contact with the photosensitive coating layer, is moved in association with the thermal spraying torch. Consequently, the thermal spraying particles adhering to the photosensitive coating layer and exerting such an undesirable influence are removed. Thus, the thermal-sprayed film can be deposited uniformly and densely in the opening (groove) having the prescribed pattern in the photosensitive coating layer.

BRIEF DESCRIPTION OF THE DRAWINGS

FIG. 4(*b*) is a view illustrating the relationship between a longitudinal direction of the substrate and the stripe groove pattern in the DFR in a plasma display panel.

BEST MODE FOR CARRYING OUT THE INVENTION

Hereinafter, the present invention will be described by way of illustrative examples with reference to the accompanying drawings. Specifically, an embodiment of the present invention in which a partition wall of a plasma display panel is produced by a plasma thermal spraying technique, which is one type of thermal spraying technique will be described.

Figure 1:
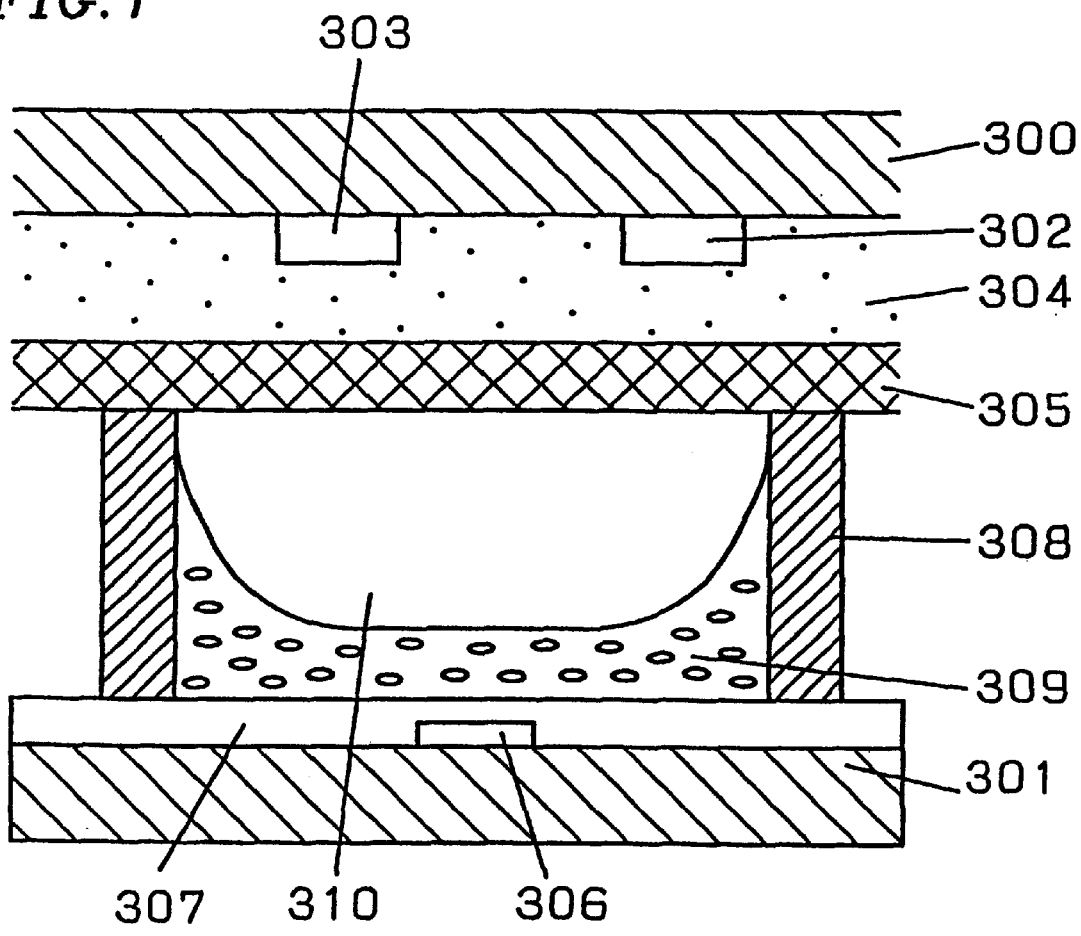
FIG. 1 is a view schematically showing a structure of a plasma display panel.
Figure 2:
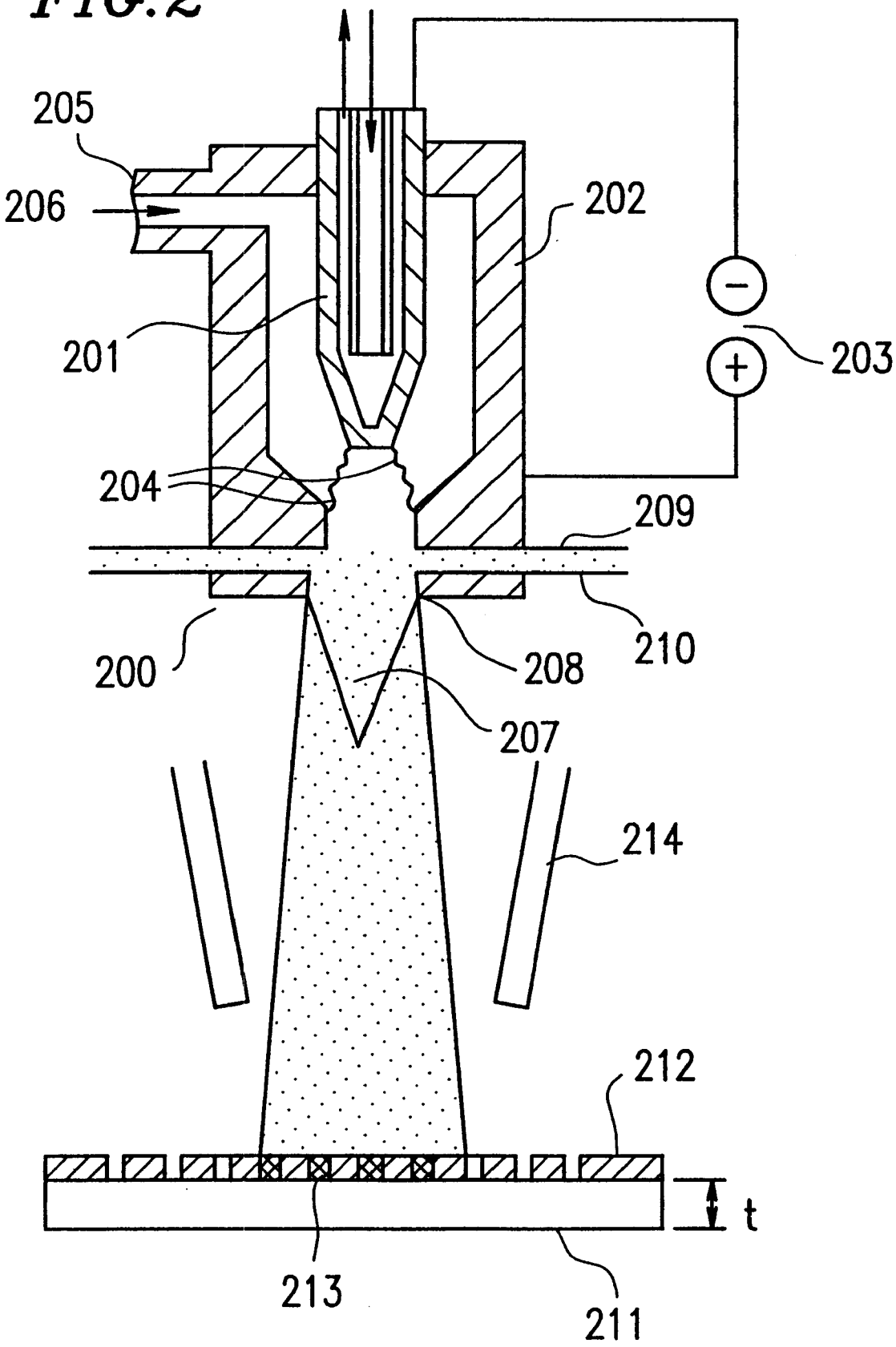
FIG. 2 is a view schematically showing a structure of a plasma thermal spraying apparatus.

FIG. 2 schematically shows a structure of a plasma thermal spraying apparatus.

As shown in FIG. 2, a plasma thermal spraying torch 200 included in the plasma thermal spraying apparatus has a water-cooled negative electrode 201 and a water-cooled positive electrode 202. A DC voltage is applied from a DC power supply 203 between the electrodes 201 and 202 to generate arc discharge 204. Plasma operating gas 206 is supplied from a gas port 205 attached to a rear end of the plasma thermal spraying torch 200. The supplied plasma operating gas 206 is heated and ionized by the arc discharge 204 generated between the electrodes 201 and 202, and is sprayed through a nozzle 208 as a plasma jet 207. As the plasma operating gas 206, argon, helium, nitrogen, hydrogen or the like can be used. In this embodiment, argon or a mixture gas of argon and helium is used.

A thermal spray material 209, which is the material of the partition wall, is carried by carrier gas from a supply port 210 in the state of powders and blown into the plasma jet 207. The supplied thermal spray material 209 is heated and melted by the plasma jet 207, and strikes at a high speed a substrate 211 (thickness: t) on which a pattern of a photosensitive coating layer 212 is formed. Thus, a coat (thermal-sprayed layer) 213 is deposited on a surface of the substrate 211.

Preferably, a cooling gas port 214 is installed to blow cooling gas to the substrate 211 simultaneously with thermal spraying of the plasma jet 207. Herein, a piping structure of the cooling gas port 214 will not be specifically described or illustrated, for simplicity.

Figure 3:
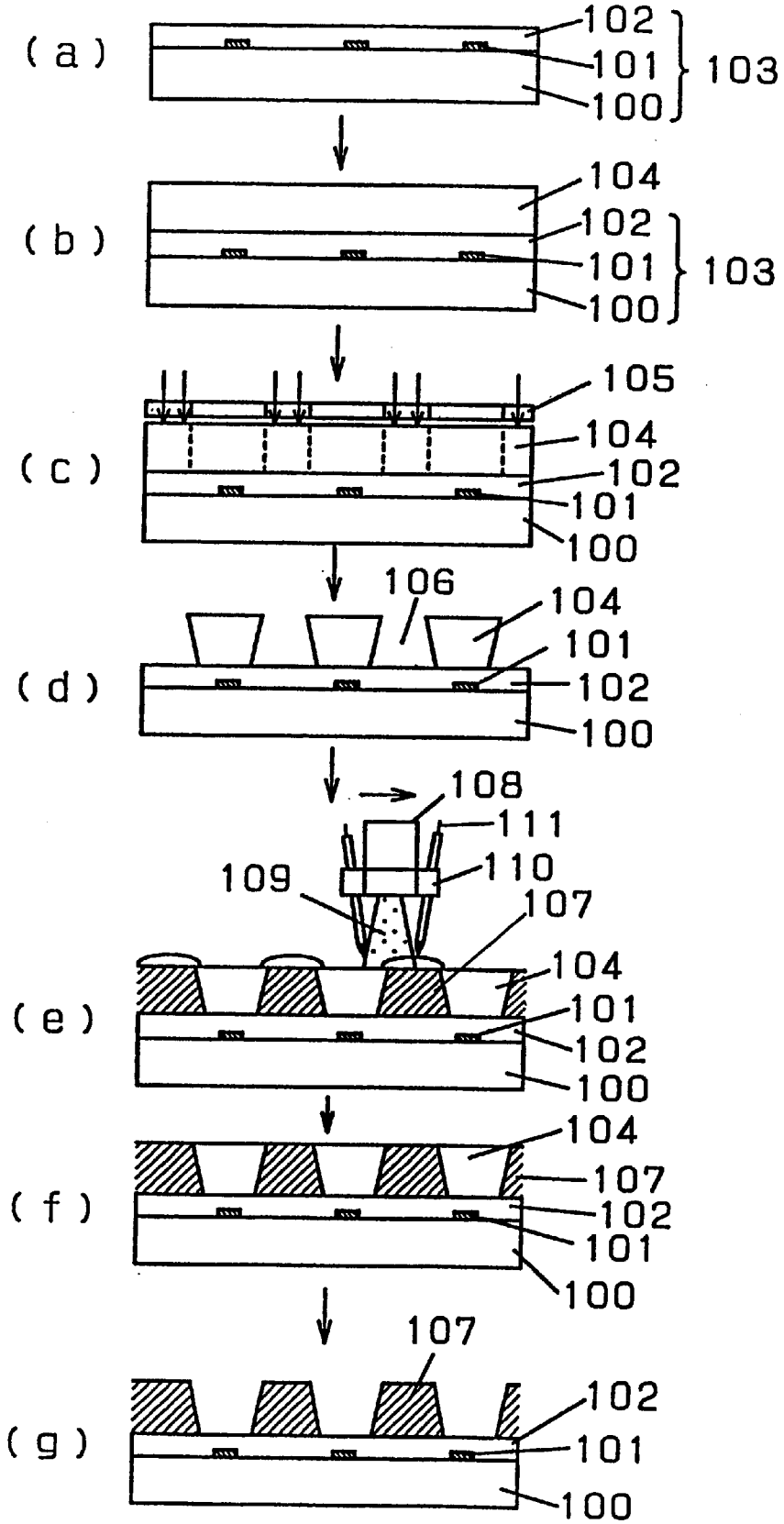
FIGS. 3(*a*) through 3(*g*) are cross-sectional views illustrating steps of a partition wall formation process using a thermal spraying technique according to the present invention.

Hereinafter, a process for forming a partition wall using a thermal spraying technique according to the present invention will be described with reference to FIGS. 3(*a*) through 3(*g*). FIGS. 3(*a*) through 3(*g*) are cross-sectional views illustrating each of steps of the above-mentioned process.

First, as shown in FIG. 3(*a*), address electrodes 101 are formed on a glass substrate 100. For the glass substrate 100, soda glass or high melting point glass having a thickness of 2.8 mm, for example, to used. After the address electrodes 101 are formed, an underlying layer 102 formed of, for example, dielectric glass is formed. In the following description, a structure including the glass substrate 100, the address electrodes 101, and the underlying layer 102 will comprehensively be referred to as a "substrate 103" for convenience. Similarly in the following description, a structure including a substrate, and address electrodes and an underlying layer formed thereon will sometimes comprehensively be referred to as a "substrate".

Then, as shown in FIG. 3(*b*), a photosensitive coating layer 104 is formed on the substrate 103 which has been formed. In this embodiment, the photosensitive coating layer 104 includes two layers of dry film resist (hereinafter, referred to as the "DFR"). Since one layer of DFR has a thickness of 60 $\mu$m, the photosensitive coating layer 104 has a thickness of 120 $\mu$m.

As shown in FIG. 3(*c*), irradiation with ultraviolet light (UV light) is performed through a photomask 105 having a prescribed pattern width and pitch, thereby conducting exposure. The amount of exposure is optimized in accordance with the pattern width and pitch of the photomask 105.

In the step shown in FIG. 3(*d*), development is performed after exposure. As a developer, a 1% aqueous solution of sodium carbonate is used. After development is performed for about 3 minutes, water-rinsing is done. By the exposure and development, grooves (openings) 106 having a prescribed stripe pattern is formed in the DFR 104. The sizes of the grooves 106 are typically as follows: the top opening width is 80 $\mu$m, and the pitch is 360 $\mu$m.

After the pattern of the grooves 106 is formed, as shown in FIG. 3(*e*), plasma thermal spraying is performed from above the substrate 103, thereby depositing a thermal-sprayed film (partition wall material) 107 in the grooves 106 in the DFR 104. Specifically, a plasma thermal spraying torch 108 has a cooling gas port 110. Simultaneously with the thermal spraying of a plasma jet 109, cooling gas 111 is blown off to the substrate 103. As the cooling gas 111, nitrogen gas is used. By the action of the cooling gas 111, the damage to the DFR 104 by the heat caused by the thermal spraying is lessened. Thus, highly precise partition wall formation is allowed. By the thermal spraying, the thermal-sprayed film 107 is mainly deposited inside the grooves 106 in the DFR 104 and is also deposited so as to fill and bulge out from the grooves 106 onto a portion of the surface of the DFR 104. The thermal-sprayed film 107, however, does not substantially deposit and adhere to the rest of the surface of the DFR 104.

Then, as shown in FIG. 3(*f*), the portion of the thermal-sprayed film 107 bulging out from the grooves 106 onto the surface of the DFR 104 is removed by polishing, and the surface of the thermal-sprayed film 107 inside the grooves 106 is flattened.

Next, as shown in FIG. 3(*g*), the substrate 103 is immersed in a removing liquid, for example, a 5% aqueous solution of sodium hydroxide, for about 10 minutes to remove the DFR 104. Thus, the partition wall 107 having a prescribed stripe pattern in correspondence with the thermal-sprayed film 107 is formed.

The formation of the partition wall by the plasma thermal spraying technique performed as described above eliminates the necessity of baking and thus eliminates the necessity of an electric energy required by the baking oven. Thus, the production cost of the partition wall can be significantly reduced.

Hereinafter, features and preferable conditions of the thermal spraying technique according to the present invention obtained as a result of the studies of the present inventors will be described in detail.

In the case where only a white material is to be used for the partition wall, powdered alumina (aluminum oxide) is used. Specifically, powdered alumina having, for example, a particle diameter distribution of 5 $\mu$m or more and 25 $\mu$m or less and a purity of 99% is used. The plasma thermal spraying torch is moved over the entire surface of the substrate at a rate of 750 mm/sec. at a pitch of 3 mm to thermal-spray the powdered material to the entire surface of the substrate. By performing the thermal spraying operation twice, a thermal-sprayed film having a thickness which is about 50 $\mu$m greater than 120 $\mu$m, which is the thickness of the DFR, is formed. The thermal spraying is performed under the following conditions: Ar and He are used as the plasma operating gas (Ar supply amount: 40 liters/min.; He supply amount: 20 liters/min.); the plasma current is 800 A; and the thermal spraying distance is 120 mm.

(Moving Direction of the Plasma Thermal Spraying Torch Over the Substrate)

The relationship between the moving direction of the plasma thermal spraying torch over the substrate and the direction of the stripe groove pattern formed in the DFR has the following influences on the quality and formation efficiency of the thermal-sprayed film.

Figure 4:
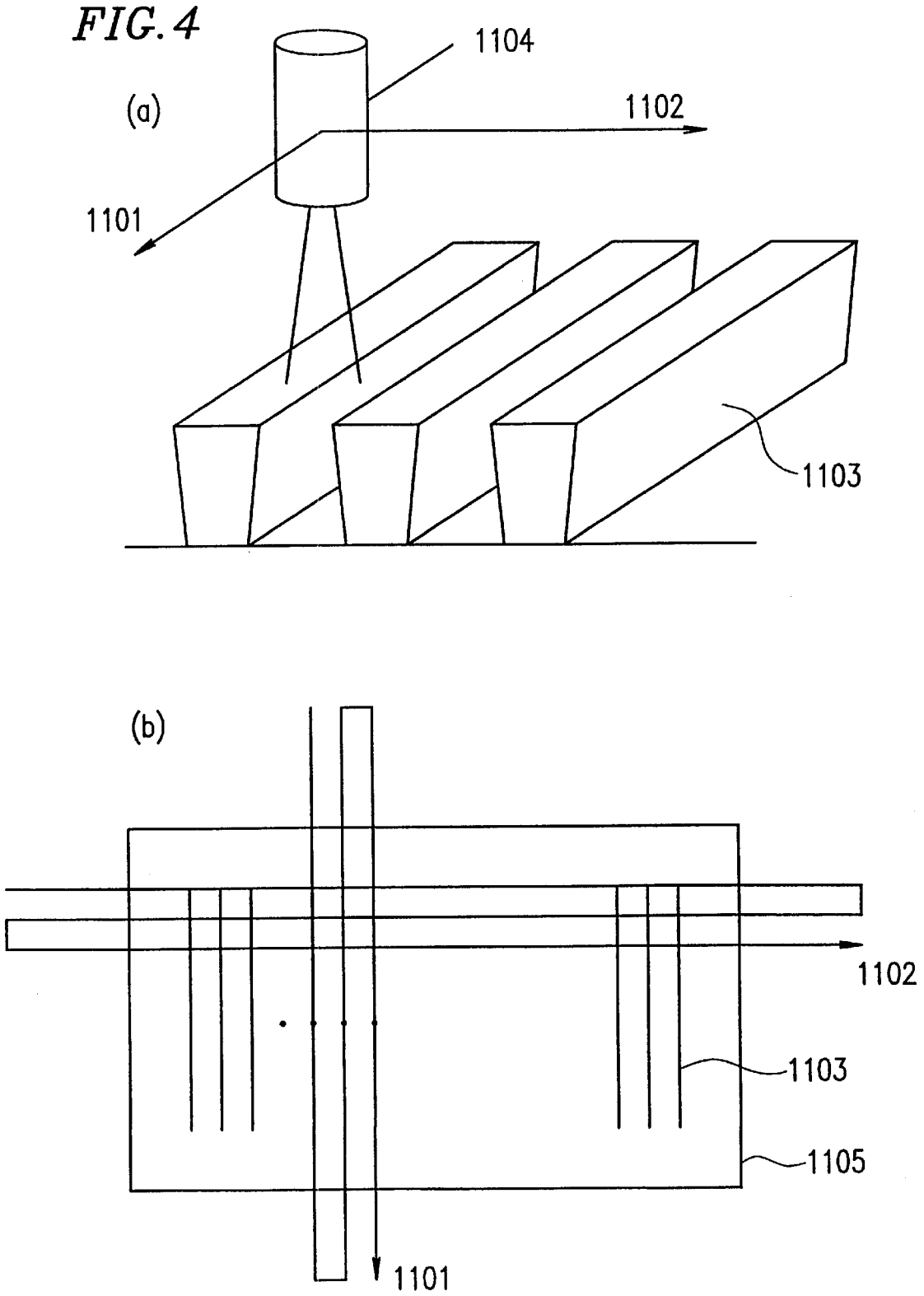
FIG. 4(*a*) is a view illustrating the relationship between the moving direction of a plasma thermal spraying torch and the direction of a stripe groove pattern in a dry film resist (DFR) on a substrate.

Specifically, the cross-section of the thermal-sprayed film which was formed when a plasma thermal spraying torch 1104 was moved in a parallel direction 1101 (FIG. 4(*a*)) to the stripe groove pattern in the DFR 1103 on the substrate and the cross-section of the thermal-sprayed film which was formed when the plasma thermal spraying torch 1104 was moved in a perpendicular direction 1102 (FIG. 4(*a*)) to the stripe groove pattern in the DFR 1103 on the substrate were observed by a scanning electronic microscope (SEM). It was confirmed that the thermal-sprayed film was formed more densely inside the openings (grooves) in the DFR in the case where the plasma thermal spraying torch 1104 was moved in the perpendicular direction 1102 and that the film formation efficiency was higher by about 10% in the case where the plasma thermal spraying torch 1104 was moved in the perpendicular direction 1102 than in the parallel direction 1101.

Generally with plasma display panels, the longitudinal direction of a substrate 1105 is perpendicular to the direction of the stripe groove pattern (herein, indicated by reference numeral 1103) in the DFR an shown in FIG. 4(*b*). Accordingly, thermal spraying toward the entirety of the surface of the substrate 1105 can be completed in a shorter period of time when the plasma thermal spraying torch is moved in the perpendicular direction 1102 to the stripe groove pattern 1103 than in the parallel direction 1101 to the stripe groove pattern 1103. The reason is given below. Since moving rate of the plasma thermal spraying torch is reduced at the turning point, the thermal spraying can be completed in a shorter period of time in the case where the number of turns is smaller.

In consideration of the above-mentioned points, the thermal spraying toward the entire substrate is performed while the plasma thermal spraying torch is moved in a direction perpendicular to the stripe groove pattern in the DFR according to the present invention.

(Adhesion characteristics of the Thermal Spray Particles to the DFR)

Thermal-sprayed particles are unlikely to adhere to the DFR and deposit only inside the openings (grooves) in the DFR. The reason is given below. The thermal-sprayed film adheres to the substrate by an anchor effect, by which the melted thermal spray particles eat into the substrate; and the thermal spray particles, when striking an organic material such as the DFR, blast the DFR and are repelled by the DFR.

However, under the conditions where the thermal spray particles are not sufficiently accelerated by the plasma jet, for example, where the amount of the plasma operating gas is smaller than an optimum amount, the thermal spray particles more easily adhere to the DFR than where thermal spraying is performed under the optimum conditions. This is considered to occur because the thermal-sprayed material aggregates before being injected into the plasma jet and thus arrives at the substrate without being sufficiently melted in the plasma jet. At this point, the particle diameter of the aggregated particles reaches several ten micrometers to several hundred micrometers. Once the thermal spray particles begin to adhere to the DFR, the particles act as a core for growth.

Figure 5:
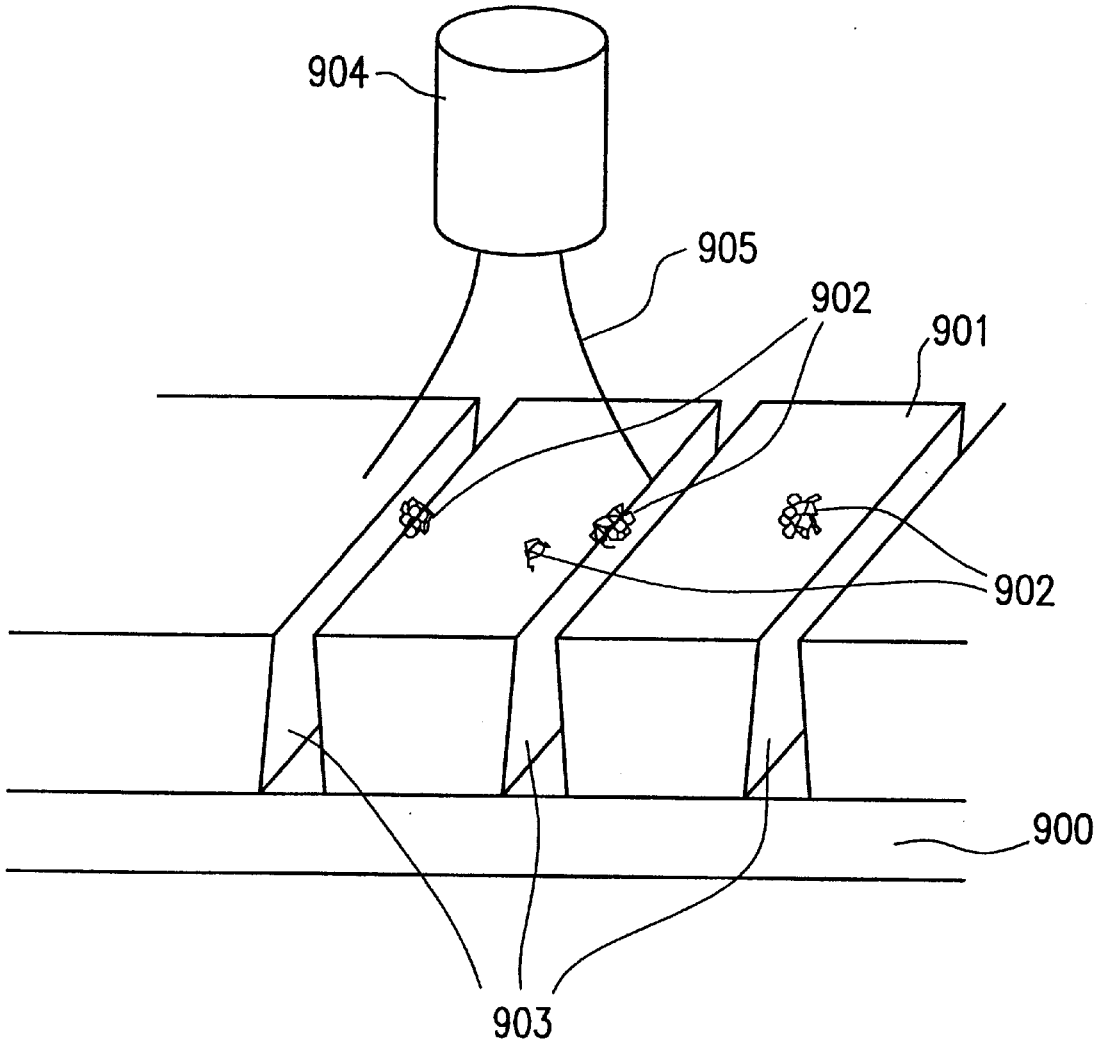
FIG. 5 is a view schematically showing thermal spray particles adhering to a surface of the DFR.

Specifically, as schematically shown in FIG. 5, particles which have been thermal-sprayed by a plasma jet 905 from a plasma thermal spraying torch 904 exist as adhering particles 902 on the surface of a DFR 901 formed on a substrate 900. In the case where a part of the adhering particles 902 covers openings (grooves) 903 in the DFR 901, the part of the adhering particles 902 which covers the openings (grooves) 903 prevents the deposition of the thermal spray particles in the openings (grooves) 903. As a result, the partition wall to be formed has nicks.

Figure 6:
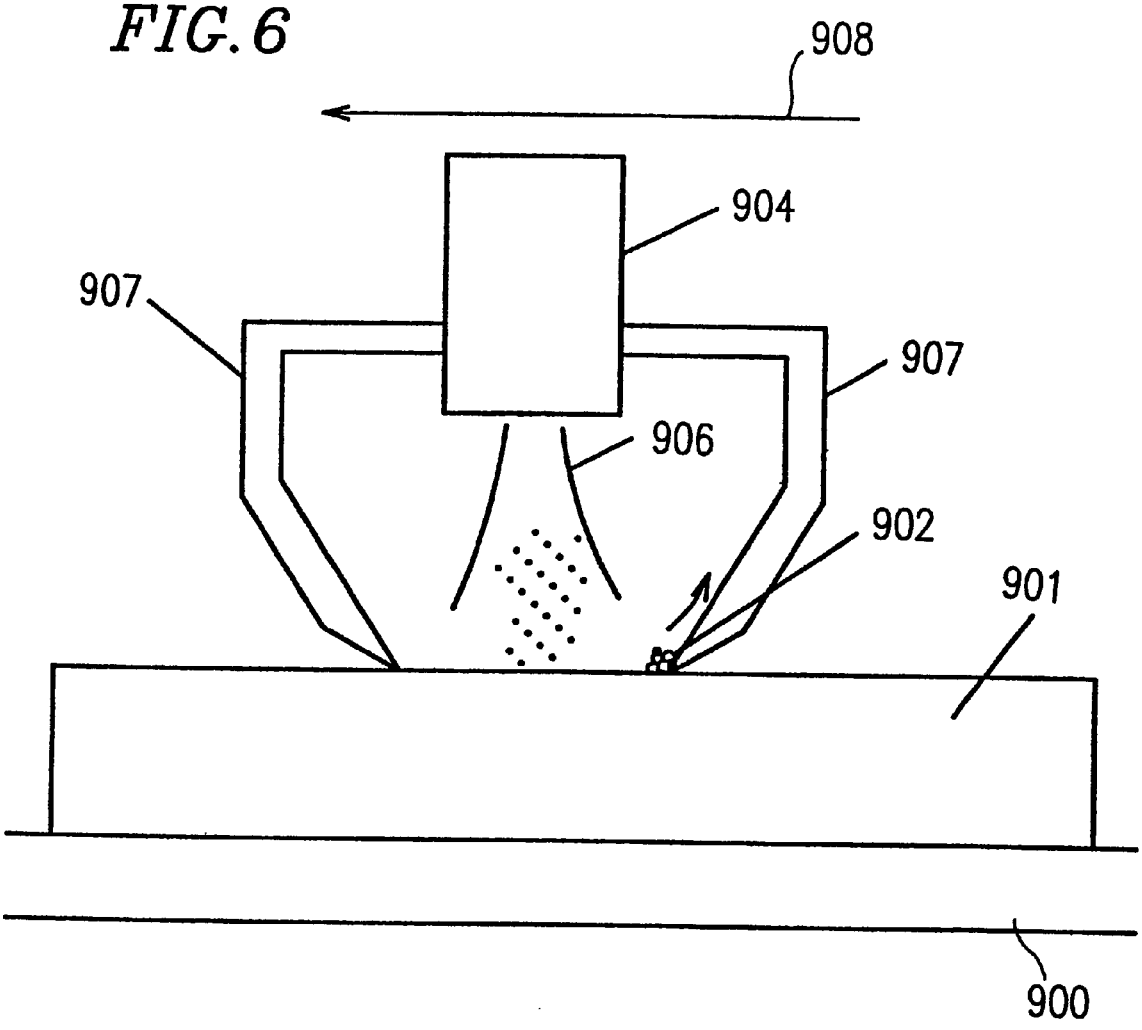
FIG. 6 is a view schematically showing a mechanism for removing the thermal spray particles adhering to the surface of the DFR.

In order to overcome such a problem, as schematically shown in FIG. 6, a mechanism 907 for removing the adhering particles 902 is attached to the plasma thermal spraying torch 904. The mechanism 907 is a squeegee having a sharp end (formed of, for example, stainless steel), and is attached to the plasma thermal spraying torch 904 so that the sharp end contacts the surface of the DFR 901 on the substrate 900. The grooves in the DFR 901 are omitted from FIG. 6.

The mechanism 907 is moved in association with the movement of the plasma thermal spraying torch 904 in a direction indicated by arrow 908. Thus, the particles 902 adhering to the surface of the DFR 901 are removed. Accordingly, the DFR 901 is suppressed from causing nicks in the partition wall. Thus, a high quality partition wall can be formed.

(Cooling Gas Port Mechanism)

With plasma thermal spraying, heat radiation from the plasma jet is occasionally used to raise the temperature of the substrate, so as to improve the quality of the thermal-sprayed film to be formed. When the heat resistance of the substrate is low, the moving rate of the plasma thermal spraying torch, for example, is maximized to prevent a local rise of the substrate temperature. However, when the substrate is formed of glass and a DFR having a very poor heat resistance is used for forming a pattern for depositing a thermal-sprayed film, it is difficult to prevent damage to the substrate only with the above-mentioned conventional techniques.

According to the present invention, the substrate is cooled before the substrate temperature is significantly raised in order to prevent the substrate from being damaged by heat even when the substrate is exposed to the heat of the plasma jet. Specifically, as described above, a cooling gas port (cooling mechanism) which moves in association with the plasma thermal spraying torch is installed. Simultaneously with the thermal spraying of the plasma jet, cooling gas (for example, nitrogen gas) is blown to the substrate. Thus, the temperature distribution in the substrate during thermal spraying (for example, the temperature difference between a front surface and a rear surface of the substrate, or the temperature difference between an area of the surface of the substrate to which the plasma jet is thermal-sprayed and its surrounding area) is maintained in a prescribed range. As the cooling gas, nitrogen gas is used. By the action of the cooling gas, the damage to the DFR by the heat caused by thermal spraying is alleviated, and thus highly precise partition wall formation is allowed.

The cooling gas port (cooling mechanism) is installed so as to move in association with the plasma thermal spraying torch, so that the substrate is uniformly cooled by the cooling gas regardless of the position of the plasma thermal spraying torch on the substrate. The location and direction of the cooling gas port (cooling mechanism) is set so that the cooling gas is directed to the vicinity of the outer periphery of the thermal spraying pattern, in order to cause the cooling gas to efficiently cool the substrate and also prevent the cooling gas from influencing the film formation.

(Prevention of Cracks in the Substrate)

In order to avoid a rapid temperature rise of the substrate by the plasma jet, installation of the above-mentioned cooling gas port (cooling mechanism) is effective. However, when the temperature distribution on the substrate becomes larger as the substrate is enlarged, the substrate may sometimes crack at the position which the plasma thermal spraying torch has passed. This is considered to occur because after the plasma thermal spraying torch passes a position of the substrate, the temperature of the position rapidly drops. In this case, the generation of cracks in the substrate cannot be solved by installing the cooling gas port (cooling mechanism).

Figure 7:
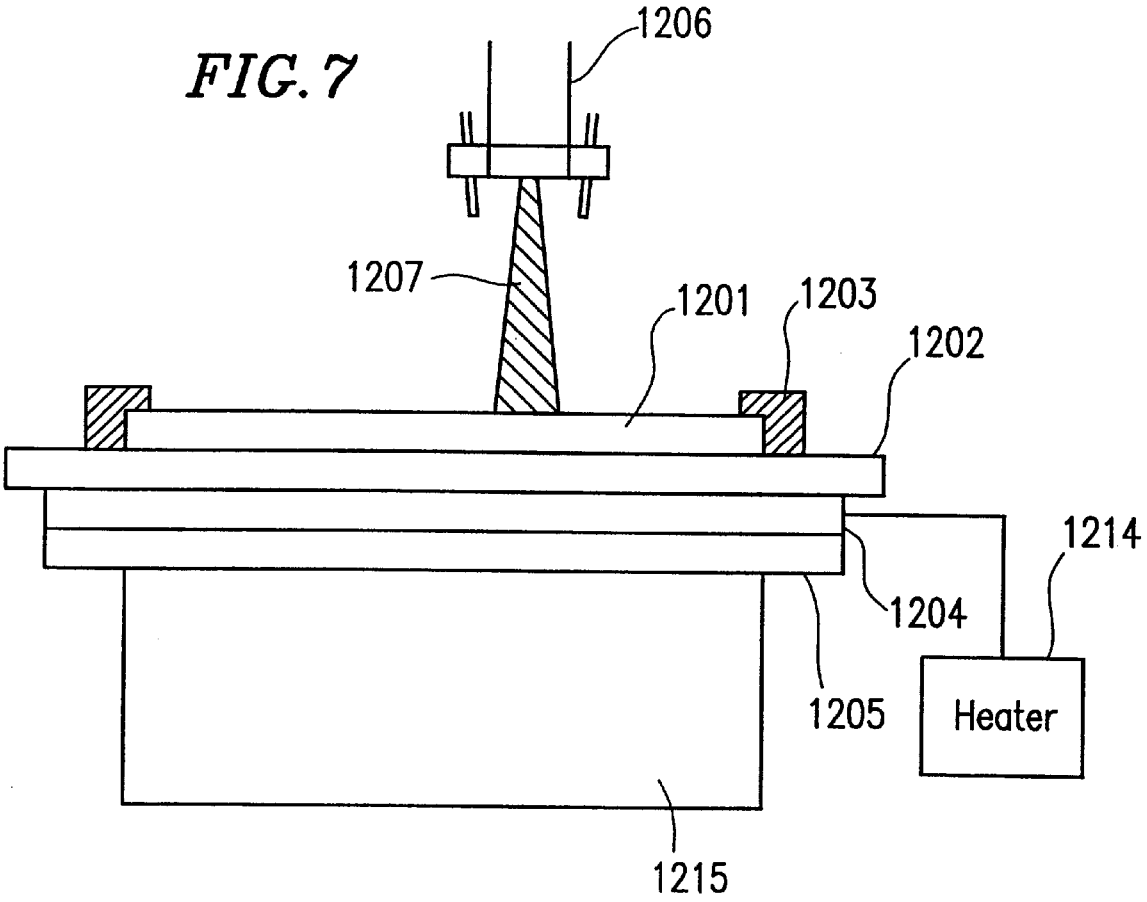
FIG. 7 is a view schematically showing a mechanism for heating and maintaining the temperature of the substrate from a rear surface thereof.

In order to overcome the above-mentioned problem, a heating and temperature-maintaining mechanism for heating and maintaining the temperature of the substrate from a rear surface thereof is installed as schematically shown in FIG. 7. Specifically, a substrate 1201 is placed on a plate 1202 and secured by a securing jig 1203. Below the plate 1202, a heating plate 1204 connected to a heater 1214 is placed to heat and maintain the temperature of the substrate 1201. The heating plate 1204 may be placed directly on a stage 1215, but the heating and temperature-maintaining efficiency is higher when the heating plate 1204 is placed on the stage 1215 through an insulating plate 1205.

Specifically, the above-mentioned mechanism is utilized to heat the substrate 1201 so that the substrate temperature becomes 60° C. to 80° C. immediately before the thermal spraying is started and also to heat and maintain the temperature of the substrate 1201 so that the temperature distribution of the substrate 1201 (for example, the temperature difference between a front surface and a rear surface of the substrate 1201, or the temperature difference between an area of the surface of the substrate 1201 to which the plasma jet is thermal-sprayed and its surrounding area) is maintained in a prescribed range during the thermal spraying of the plasma jet 1207 from the plasma thermal spraying torch 1206 (the structure of the plasma thermal spraying torch 1206 is described above and shown here in a simplified manner). Thus, partition wall formation can be realized by the thermal spraying technique without generation of cracks even on a glass substrate which is as large as 1000 mm×600 mm.

The heating and temperature-maintaining mechanism from the rear surface of the substrate mentioned above can be used together with the cooling mechanism (cooling gas port) used for the surface of the substrate described above.

(Optimum Particle Diameter)

Hereinafter, the results of the studies performed by the present inventors on the optimum particle diameter of the powder used for the thermal spraying for partition wall formation will be described.

Generally with thermal spraying, when a thermal-sprayed film is formed on a flat substrate, the rate of film formation is higher as the particle diameter of the powder to be thermal-sprayed is larger, for the following reason. As the particle diameter of the powder to be thermal-sprayed is larger, the kinetic momentum is larger and thus the particles are injected in the direction of the central axis of the plasma jet more efficiently. As a result, the rate and temperature of the particles at the time of thermal spraying are more sufficiently improved. However, in the case where the thermal spray particles are placed and deposited inside the stripe openings (grooves) in the DFR formed on the substrate as with the present invention, only the particles having a smaller diameter than a top width Wa of the top end of the openings (grooves) in the DFR can be put therein. Accordingly, the primary particle diameter D of the plasma thermal spray material should be in a specific appropriate range in order to allow the thermal spray particles to be placed and deposited inside the openings (grooves) in the DFR efficiently.

Figure 8:
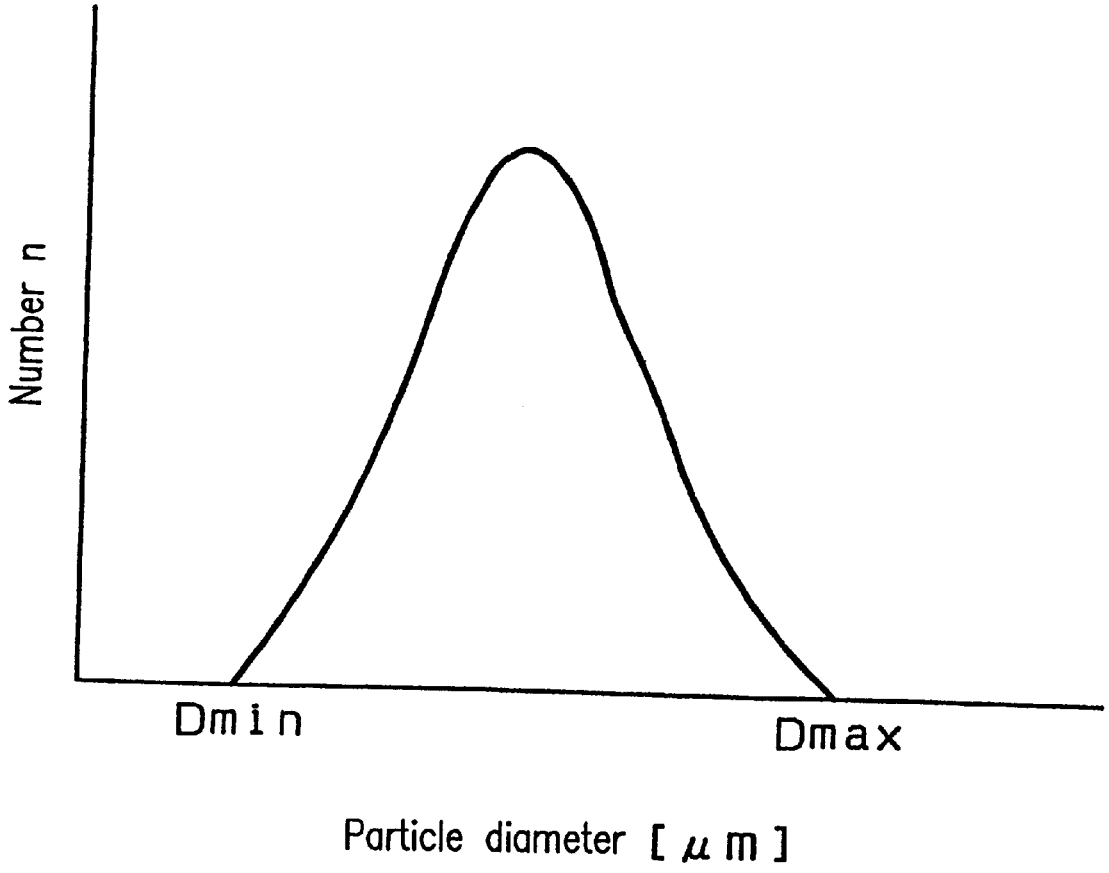
FIG. 8 is a graph illustrating a general distribution of a primary particle diameter D of powdered particles of a thermal spray material.

FIG. 8 shows a general exemplary distribution of the primary particle diameter D of the thermal spray material. Where the horizontal axis shows a logarithmic representation of the particle diameter D, the distribution of the number of the particles is a Gaussian distribution. When the maximum value Dmax of the particle diameter exceeds 0.7·Wa (where Wa is the top width of the openings (grooves) in the DFR; see FIG. 11), the thermal spray particles cannot be efficiently placed inside the openings (grooves) in the DFR. When the minimum value Dmin of the particle diameter is 5 μm or less, the kinetic momentum of the thermal spray particles is too small to allow the thermal spray particles to be efficiently injected into the plasma jet, resulting in a reduced film formation efficiency.

Accordingly, the primary particle diameter D of the thermal spray material is preferably 5 μm or more and 0.7·Wa or more (where Wa is the top width of the openings (grooves) in the DFR).

(Polishing)

Polishing for removing a portion of the thermal-sprayed film bulging out onto the surface of the DFR and flattening the surface of the thermal-sprayed film deposited in the grooves in the DFR will be described.

The polishing is preferably wet polishing. Specifically, a polishing paper having a prescribed roughness (for example, No. 100 polishing paper by JIS) is first used to scrape off the portion of the thermal-sprayed film bulging out onto the surface of the DFR. Then, a finer polishing paper (for example, No. 400 polishing paper by JIS) is used to polish the surface of the DFR to reduce the surface roughness of the top surface of the thermal-sprayed film in the grooves in the DFR (corresponding to the top surface of the partition wall to be formed). When the surface roughness of the partition wall of the plasma display panel is large, the electric discharge leaks from an adjacent cell through the partition wall, which causes erroneous display. In order to prevent erroneous display by such a cause, the top surface of the partition wall needs to be polished (flattened) until the surface roughness Rz of the top surface becomes in the range of ±3 μm.

Figure 9:
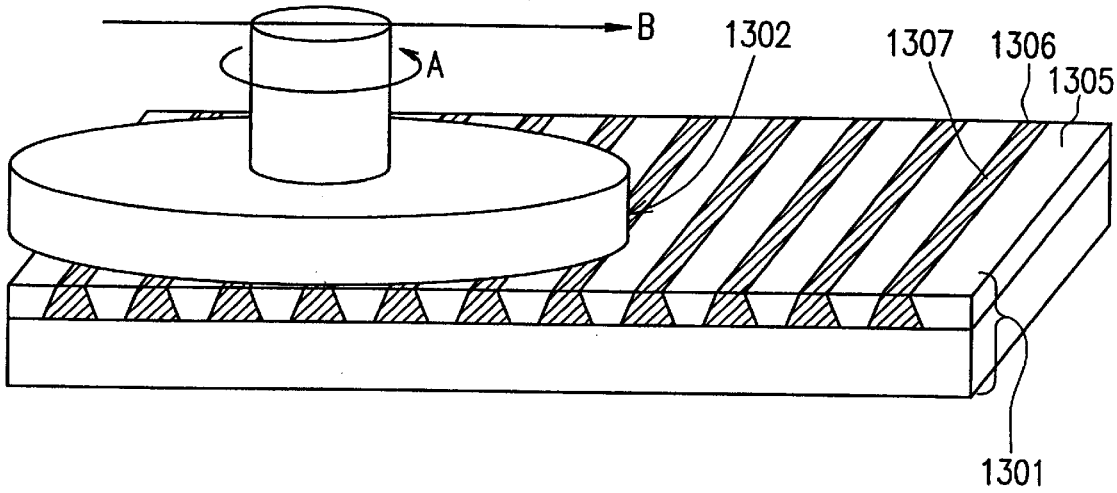
FIG. 9 is a view schematically illustrating a wet polishing step carried out in the process according to the present invention.

FIG. 9 schematically shows a typical polishing technique. A substrate (herein, comprehensively indicated by reference numeral 1301) has a thermal-sprayed film 1307 in openings 1306 in a DFR 1305. A surface of the substrate 1301 is polished with a polishing paper attached to a pad 1302 having a diameter of 20 mm to 30 mm, which is sufficiently larger than the width and pitch of the openings 1306 in the DFR 1305. At the time of polishing, the pad 1302 moves in a direction of arrow B while rotating in a direction of arrow A to polish the surface of the substrate 1301 (more specifically, the surface of the DFR 1305 and the surface of the thermal-sprayed film 1307). At this point, the polishing paper is attached to the pad 1302 so as to slightly expand outward by an air pressure.

By polishing the surface using an apparatus having such a structure, the large roughness of the surface of the substrate 1301 is absorbed, and the surface of the substrate 1301 is polished with certainty.

(Handling of Residual DFR)

During removal of the DFR after the thermal-sprayed film is deposited inside the openings (grooves) in the DFR, the DFR may not be completely removed, resulting in the DFR cut into a length of several millimeters remaining between the partition walls. As a result of detailed studies of this phenomenon, the following has been confirmed: as shown in FIG. 10(*a*), a groove 106 in a DFR 104 was initially trapezoidal; a top portion of the DFR 104 is removed and the top width of the groove 106 is increased during the thermal spraying, and as a result, the groove 106 obtains a shape having an intermediate portion thereof being constricted and narrowed, as schematically shown in FIG. 10(*b*).

Accordingly, when the DFR 104 is removed, the DFR 104 which has been expanded is caught in the vicinity of a top end of the thermal-sprayed film (partition wall) 107 deposited inside the groove 106. Thus, a part of the DFR 104 is cut off and remains as residue between the partition walls.

Figure 10:
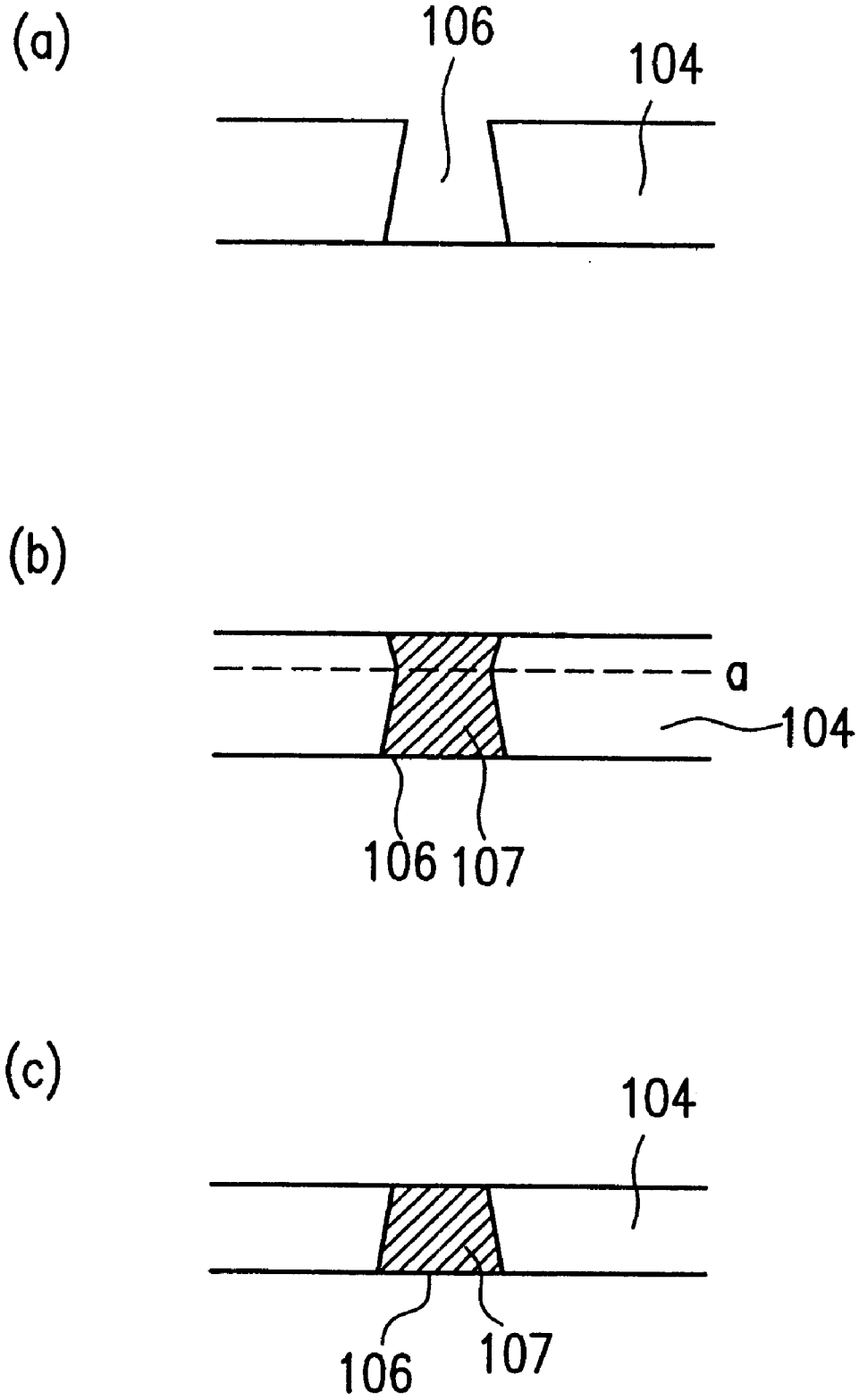
FIGS. 10(*a*) through 10(*c*) are views schematically illustrating a process for compensating for a change in the groove pattern in the DFR caused by thermal spraying, thus to suppress generation of residual DFR.

In order to prevent such a phenomenon, prior to the removal of the DFR 104, a portion of the DFR 104 from the surface to the level indicated by the dashed line a in FIG. 10(*b*), at which the groove 106 is narrowest, is removed by polishing. Thus, as schematically shown in FIG. 10(*c*), the groove 106 inside the DFR 104 and the thermal-sprayed film (partition wall) 107 deposited inside the groove 106 are again trapezoidal, which suppresses generation of the above-described problem at the time of removal.

The above-described polishing can be carried out as a part of a polishing procedure for flattening the surface of the DFR (top surface of the partition wall) described above with reference to FIG. 9. The specific amount to be polished (depth of the DFR to be removed, i.e., the depth of the dashed line a in FIG. 10(*b*) from the surface) is typically about 10 $\mu$m.

In order to remove a part of the DFR 104 by polishing as described above for preventing the generation of the residual DFR at the time of removal, the thickness of the DFR 104 needs to be set to be greater than the necessary height of the partition wall by at least the depth to be removed by polishing.

(Optimization of the Groove Pattern in the DFR)

Figure 11:
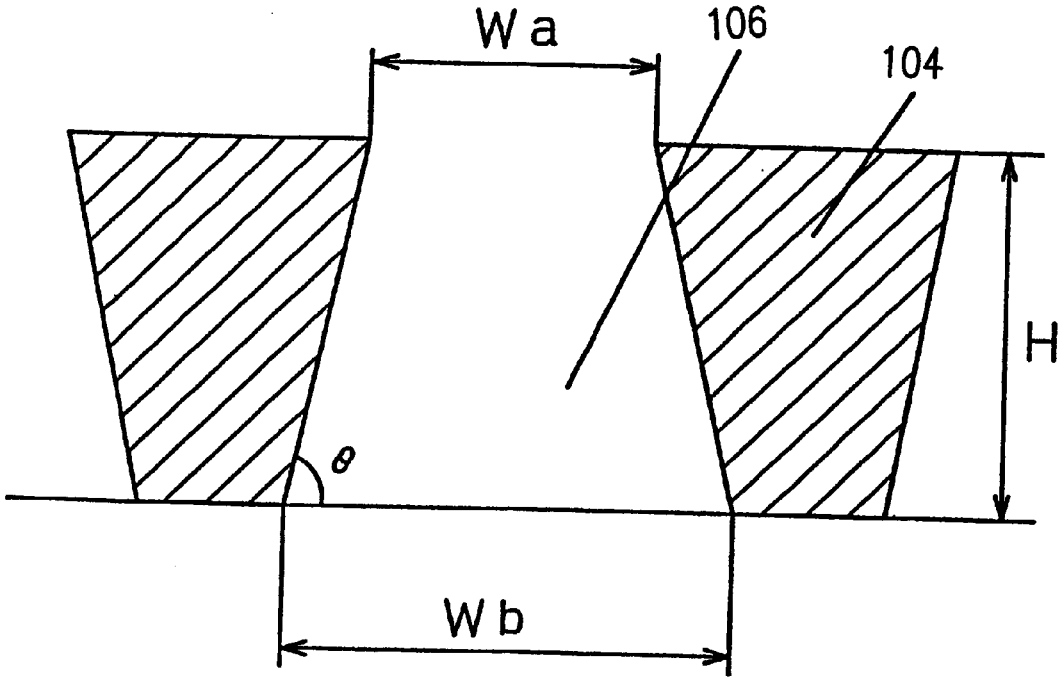
FIG. 11 is a cross-sectional view of a typical groove pattern in the DFR.

The cross-sectional profile of the DFR can be changed by changing the amount of exposure when the groove in the DFR is patterned. FIG. 11 schematically shows a cross-section of the DFR 104. Hereinafter, with reference to FIG. 11 and experimental data in FIGS. 12 through 14, conditions for forming the grooves 106 having a prescribed pattern in the DFR 104 will be discussed. A photomask for forming the grooves 106 in the DFR 104 has the following ratio of width L of a line portion with respect to width S of a space portion: L/S=70 $\mu$m/290 $\mu$m.

Figure 12:
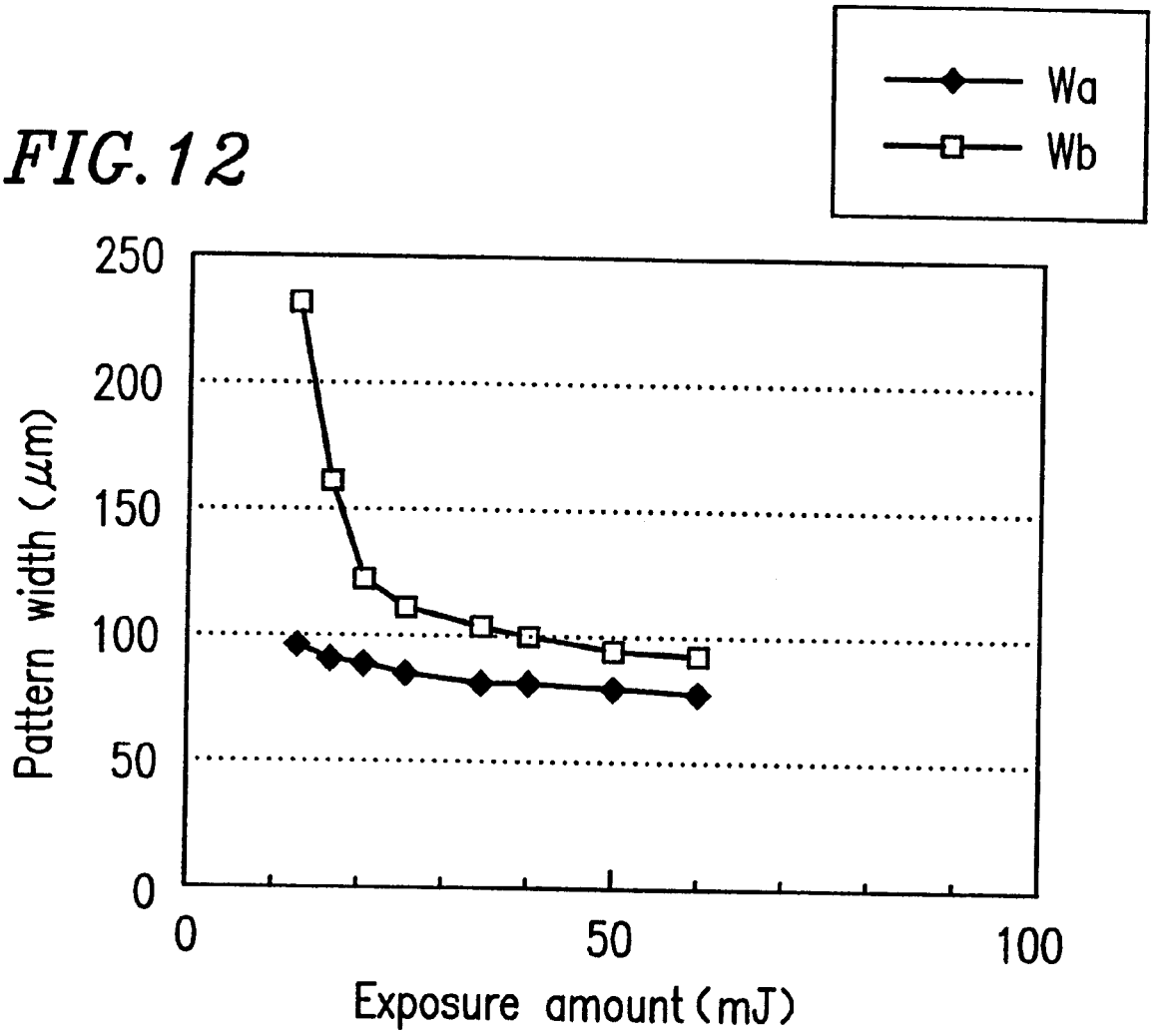
FIG. 12 is a graph illustrating the relationship among the exposure amount of DFR, a top width Wa of a groove formed in the DFR, and a bottom width Wb of the groove.

FIG. 12 shows the relationship among the amount of light irradiating the DFR 104 (amount of exposure), the top width Wa of a top portion of the groove 106 formed in the DFR 104, and a bottom width Wb of a bottom portion of the groove 106, the relationship being obtained when the DFR 104 has a thickness of 100 $\mu$m. Specifically, partition walls were formed in accordance with the production process described with reference to FIGS. 3(*a*) through 3(*g*), with the developing amount being set identical and only the exposure amount being varied. The characteristics of the produced partition walls were evaluated.

Figure 13:
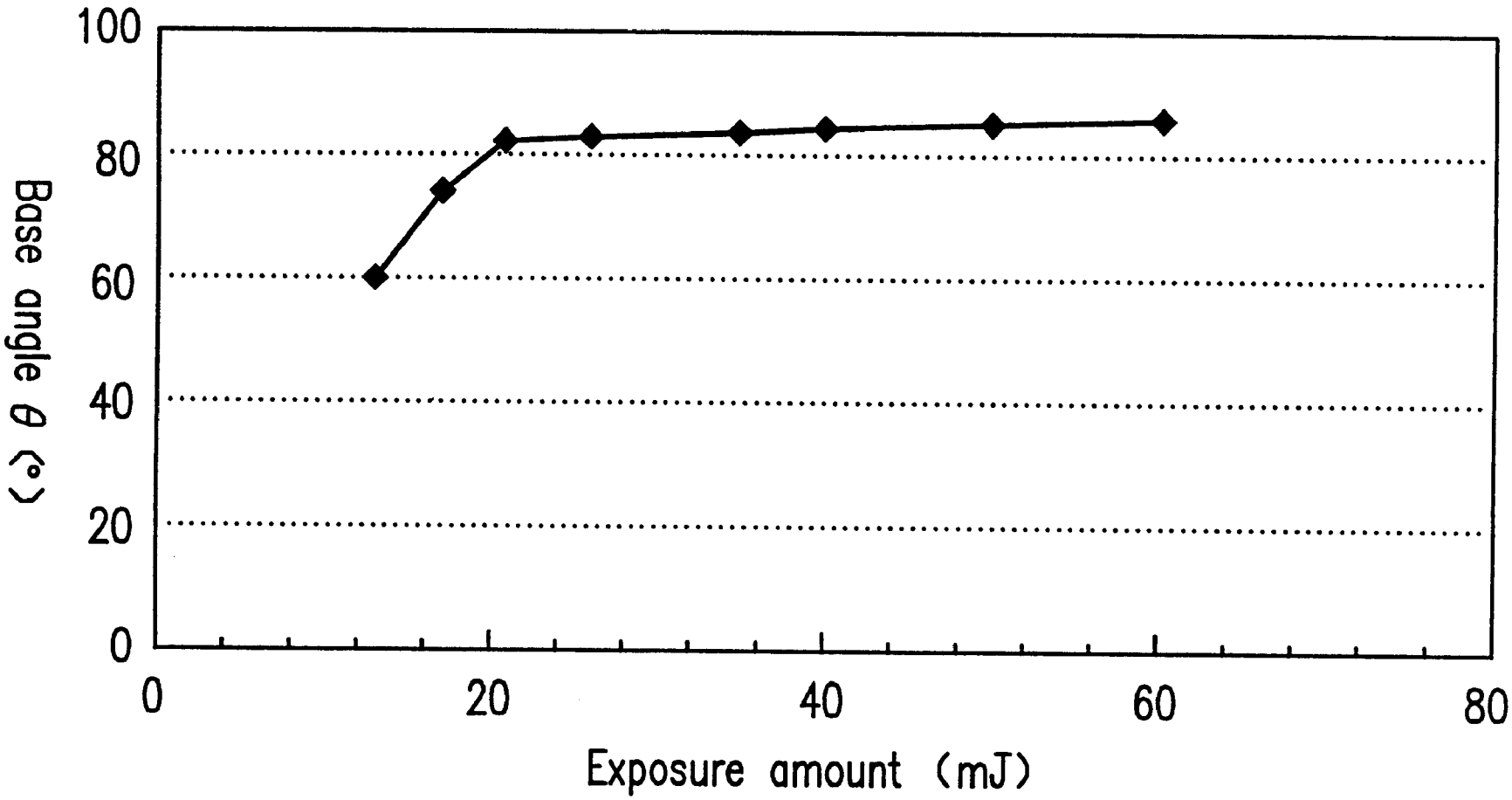
FIG. 13 is a graph illustrating the relationship between the exposure amount of DFR and the base angle θ of the partition wall to be formed.

Based on the evaluation, as the exposure amount reduces, the top width Wa and the bottom width Wb of the groove 106 both increase. The ratio of increase is larger in the bottom width Wb than the top width Wa. Accordingly, as shown in FIG. 13, base angle θ of the groove 106 (also referred to as the base angle θ of the partition wall) reduces as the exposure amount reduces.

Figure 14:
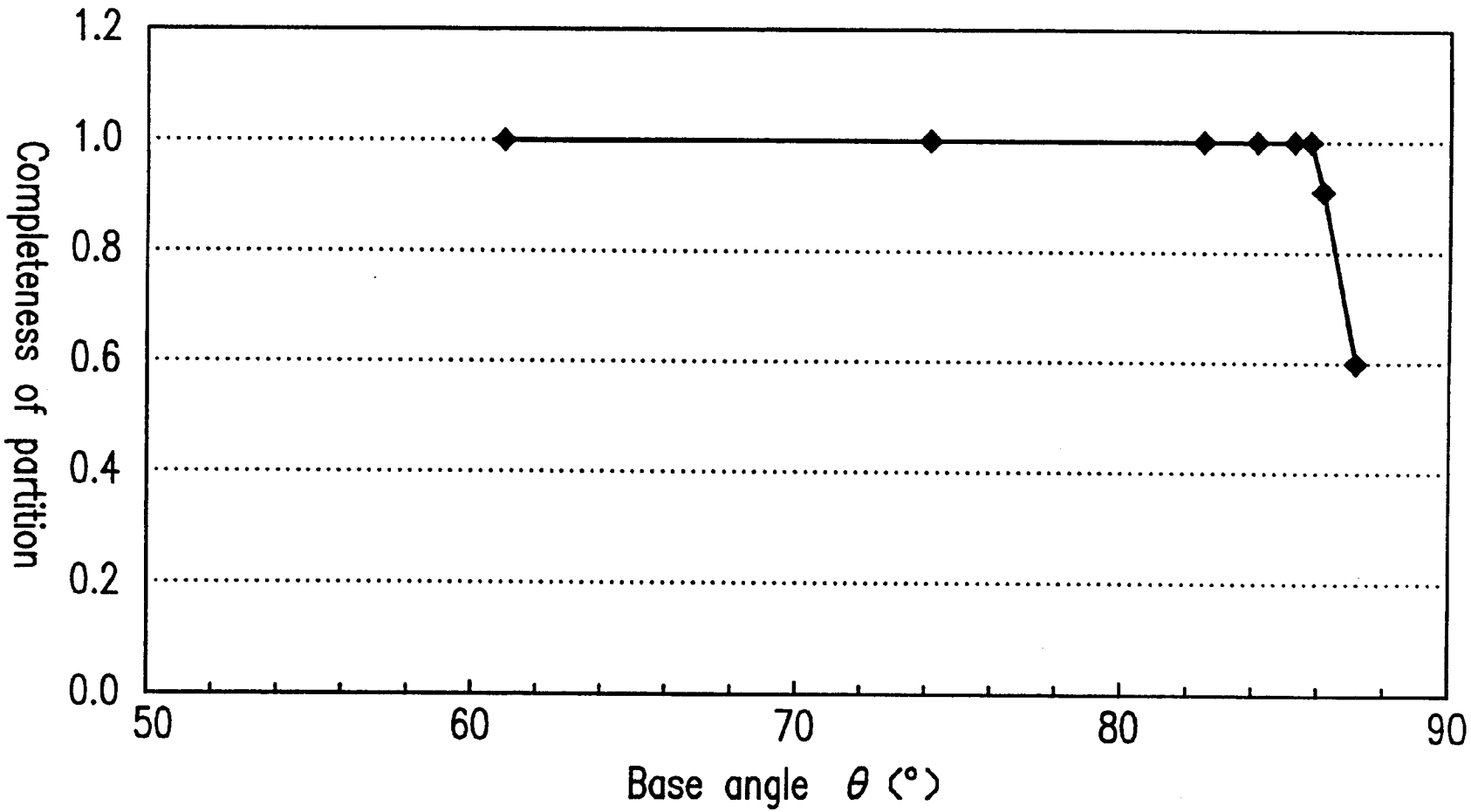
FIG. 14 is a graph illustrating the relationship between the base angle θ of the partition wall to be formed and the completeness of the partition wall.

FIG. 14 shows the relationship between the base angle θ of the DFR 104 and the completeness of the partition wall. The "completeness of the partition wall" is a parameter which shows the state of nicks in the finished partition walls in a relative representation. The state where the finished partition wall has no defect is represented by "1", and the state where the partition wall is removed from the substrate is represented by "0". The groove 106 in the DFR 104 was formed through exposure and development using a photomask having a pitch of 360 $\mu$m and a pattern width of 70 $\mu$m as described above.

Based on FIG. 14, when the base angle θ is 86 degrees or less, the completeness of the partition wall is 1. In actuality, no practical problem occurs when the base angle θ is more than 86 degrees but less than 90 degrees.

The reasons why the completeness of the partition wall depends on the base angle θ will be discussed below.

The partition wall material deposited by the plasma thermal spraying technique is buried with no gap inside the openings (grooves) in the DFR. The DFR is expanded upward and laterally when removed and accordingly pushes the thermal-sprayed film (partition wall) inside the grooves vertically and laterally. As the base angle θ of the partition wall is larger, the force of pushing the partition wall laterally by the expansion of the DFR is larger. In an extreme case, the force pushes the partition wall down.

The strength of the partition wall increases in proportion to the width of the partition wall. As the width of the partition wall increases, the bass angle θ of the partition wall increases. Accordingly, when the width of the partition wall increases, the base angle θ of the partition wall approaches 90 degrees; and when the width of the partition wall decreases, the base angle θ of the partition wall decreases. For example, where thickness H of the DFR 104 is 100 $\mu$m and the top width Wa of the groove 106 is 30 $\mu$m (FIG. 11), the bottom width Wb needs to be increased to 80 $\mu$m in order to obtain a sufficient mechanical strength of the partition wall and facilitate the removal of the DFR 104. When the bottom width Wb is 80 $\mu$m, the base angle θ of the partition wall is 76 degrees.

As the base angle θ of the partition wall is decreased, the thermal spray particles are not densely deposited on the bottom of the groove 106 in the DFR 104 even by plasma thermal spraying. The reason is that the bottom of the trapezoidal groove 106 in the DFR 104 is in the blind spot for the thermal spray particles which generally advance straight. When the base angle θ of the partition wall is small, the thermal-sprayed film is coarse at both ends of the bottom of the groove 106 in the DFR 104, and thus the adhesive strength of the thermal-sprayed film (partition wall) is deteriorated. In order to suppress such deterioration of the adhesive strength of the thermal-sprayed film (partition wall), the base angle θ of the partition wall is preferably 60 degrees or more.

In the above description, the exposure amount is adjusted to change the base angle θ of the partition wall. Alternatively, the same effect can be achieved by changing the amount of development.

The above-described phenomenon that the completeness of the partition wall formed by the thermal spraying technique depends on the pattern of the groove in the DFR in which the thermal spray material is buried for forming the partition wall does not cause any problem when, for example, a cathode electrode of a DC-type plasma display panel is formed by a thermal spraying technique. The reasons will be discussed.

First, a cross-section of a cathode electrode, of a DC-type plasma display panel, formed by a thermal spraying technique generally has an aspect ratio of 0.3 to 0.4. By contrast, the partition wall formed by the thermal spraying technique in accordance with the present invention generally has an aspect ratio of as large as 1.2 to 3.0. This means that the center of gravity of the thermal-sprayed film (partition wall) formed in accordance with the present invention is at a higher level than the center of gravity of the cathode electrode, and accordingly the thermal-sprayed film (partition wall) formed in accordance with the present invention has a low mechanical strength against application of a pressure caused by the expansion of the DFR at the time of removal of the DFR.

Second, the thermal spray material used when a cathode electrode of a DC-type plasma display panel is formed by a thermal spraying technique generally has a low melting point like metal aluminum (melting point: 660° C.). Accordingly, the adhesive force between thermal spray particles in the thermal-sprayed film is strong, and the thermal spray particles adhere to the substrate strongly. Moreover, under the thermal spraying conditions where such a low melting point thermal spray material is sufficiently melted, the thermal influence given by the plasma jet to the substrate at the time of thermal spraying is small. By contrast, the thermal spray material used when a partition wall is formed by the thermal spraying technique in accordance with the present invention is generally an oxide. Alumina, for example, has a high melting point of 2010° C. Under the thermal spraying conditions where alumina is sufficiently melted, the thermal influence given by the plasma jet to the substrate at the time of thermal spraying is very large. Accordingly, the thermal spraying for forming a partition wall according to the present invention requires conditions for reducing quantity of generated heat compared to the general thermal spraying conditions which are considered to be preferable for thermal-spraying an oxide. In addition, since the thermal spray material is an oxide, neither the adhesive force between the thermal spray particles inside the thermal-sprayed film nor the adhesive force to the substrate is great.

Due to the above-described reasons, it is preferable to form the groove in the DFR so as to have a pattern facilitating the removal of the DFR in order to perform stable removal of the DFR, when a partition wall is formed by the thermal spraying technique in accordance with the present invention unlike the case where a cathode electrode of a DC-type plasma display panel is formed by a thermal spraying technique.

(Selection of the Thermal Spray Material)

A partition wall is formed by the plasma thermal spraying technique is almost entirely formed of a desired material, unlike a partition wall formed of a mixture such as a paste by a printing technique. Accordingly, the partition wall formed by the plasma thermal spraying technique does not cause problems involved in the conventional art, for example, a problem of an organic binder in the paste remaining as residual carbon. Thus, the partition wall formed by the plasma thermal spraying technique effectively stabilizes discharge.

A partition wall formed of a white material having a high reflectance, for example, aluminum oxide used in this embodiment improves the utilization factor of visible light from a fluorescent material provided on a side surface of the partition wall. Specifically, the partition wall formed of a white material provides a luminance which is 1.2 times higher than the luminance provided by a partition wall entirely formed of a black material with side surfaces thereof being black.

A partition wall formed of a white material improves the luminance of a plasma display panel as described above, but may deteriorate the display contrast because a sufficiently black display is not obtained in a black display state. In order to avoid such a problem, only a top end and the vicinity thereof of the partition wall can be formed of a black material.

Specifically, the following procedure is adopted after a groove in a DFR having a thickness of 120 $\mu$m is formed using a photo mask pattern having a pitch of 360 $\mu$m and a width of 70 $\mu$m. First, aluminum oxide ($Al_2O_3$) having a particle diameter distribution of 5 $\mu$m to 25 $\mu$m is deposited as a white material inside the groove of the DFR to a thickness of about 90 $\mu$m by thermal spraying. Next, a mixture material of $Al_2O_3$ and 13% $TiO_2$ having a particle diameter distribution of 5 $\mu$m to 30 $\mu$m is deposited by thermal spraying so that the top surface of the thermal-sprayed film is higher than the surface of the DFR by about 50 $\mu$m. Then, as described above, a portion of the thermal-sprayed film bulging out from the surface of the DFR and a portion of the DFR from the surface to a depth of about 10 $\mu$m are removed by polishing. Then, the DFR is removed.

By such a procedure, a two-layer partition wall is formed, which is formed of a white material from the bottom to a height of 90 $\mu$m and is formed of a black material in a portion, having a thickness of 20 $\mu$m, on the white portion. Using the two-layer partition wall, a plasma display panel having excellent characteristics both in the luminance and the contrast is formed.

The height of the partition wall and the shape of the pattern of the photomask used for forming the partition wall are not limited to the specific examples described above, and the same effect can be achieved by arbitrarily changing them.

As the white material, other materials than aluminum oxide (for example, spinel) can be used. As the black material, other materials (for example, chromium oxide or titanium oxide) can be used to achieve the same effect. When a mixture of aluminum oxide and titanium oxide is used, aluminum oxide and titanium oxide can be melted.

Formation of the above-described two-layer partition wall by a baking technique using a paste requires the baking temperature to be controlled. The plasma thermal spraying used in accordance with the present invention does not require baking itself and thus realize the formation with a simple process.

The arrangement of the colors of the two-layer or multiple-layer partition wall is not limited to the examples described above. According to the thermal spraying technique of the present invention, colors can be arbitrarily arranged by appropriate selection of the partition wall materials.

A paste used for a baking technique generally contains lead, but the thermal spraying technique can form the partition wall with materials containing no lead. Accordingly, the thermal spraying technique is effective for preventing the partition wall formation from causing the lead pollution.

The studies performed by the present inventors have confirmed that the whiteness of aluminum oxide used as a partition wall material changes in accordance with the plasma energy quantity at the time of thermal spraying.

Figure 15:
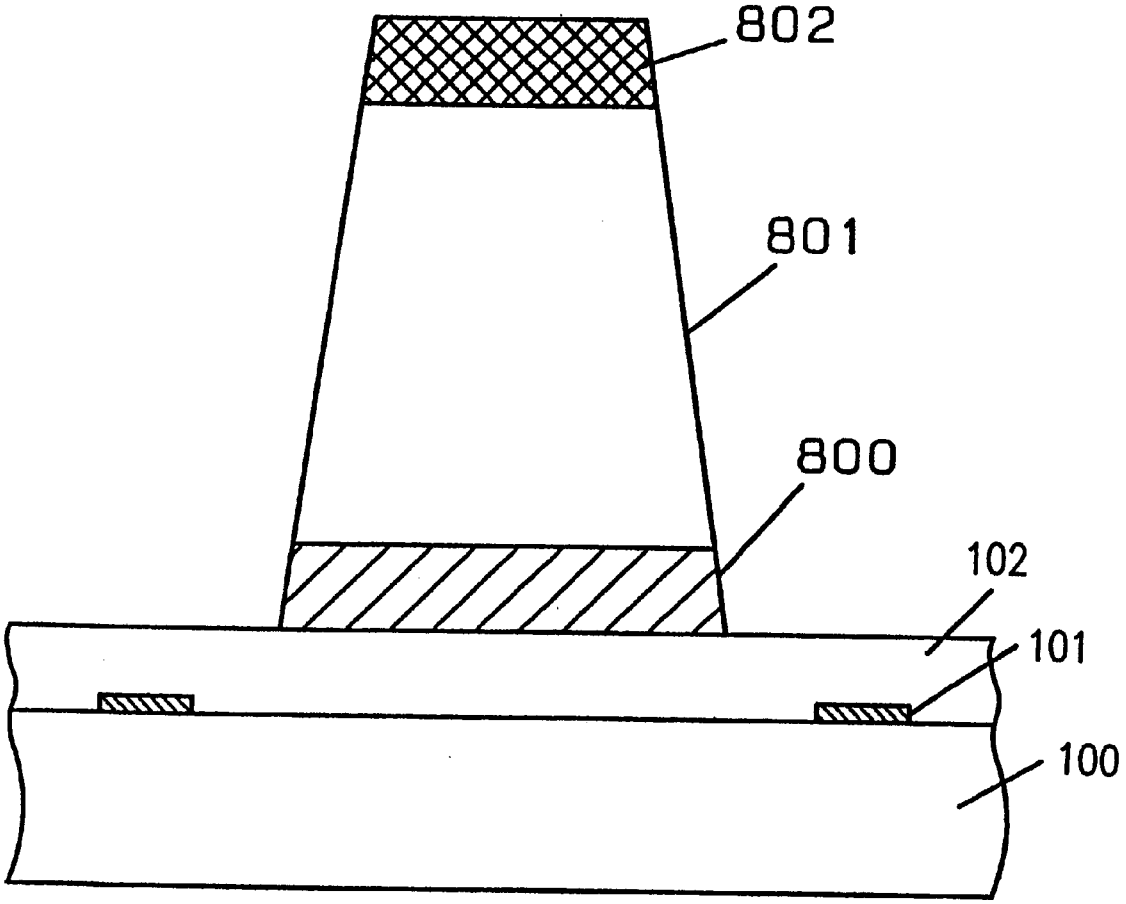
FIG. 15 is a cross-sectional view schematically showing a partition wall having a multiple-layer structure.

The plasma energy quantity can be changed by adjusting the amount of helium with respect to argon in the plasma operating gas. Specifically, as the amount of helium to increased with respect to argon supplied in a constant amount of 40 liters/min., the color of the thermal-sprayed film of aluminum oxide changes to a grayish color. The adhesive strength between the substrate and the partition wall is maximized when helium is supplied in an amount of 20 liters/min. Based on these results, a partition wall having a shape shown in FIG. 15 was formed by the plasma thermal spraying technique in the following manner.

As a bottom portion of the partition wall, a first thermal-sprayed film 800 formed of aluminum oxide is formed to a thickness of about 20 $\mu$m while argon is supplied in an amount of 40 liters/min. and helium is supplied in an amount of 20 liters/min. Thus, a sufficient adhesive force to the underlying layer 102, which is formed on the substrate 100 so as to cover the address electrodes 101, is secured.

Next, while only argon is supplied as the plasma operating gas in an amount of 40 liters/min., a second thermal-sprayed film 801 formed of aluminum oxide is formed to a thickness of about 80 μm. Thus, a partition wall portion having white side surfaces is formed.

Then, a mixture material of $Al_2O_3$ and 13% $TiO_2$ is thermal-sprayed to the resultant partition wall portion to form a third thermal-sprayed film 802. At this point, the third thermal-sprayed film 802 is formed so that a top surface thereof is at a higher level than the surrounding surface of the DFR (not shown) by about 50 μm.

After that, the portion of the third thermal-sprayed film bulging out from the surface of the DFR and a portion of the DFR from the surface to a depth of about 10 μm are scraped off by the above-mentioned wet polishing technique, and further the DFR is removed. Thus, the partition wall having a structure shown in FIG. 15, having a black top portion and white side surfaces, and having a sufficient adhesive force to the substrate is formed.

The plasma energy quantity can alternatively be adjusted by changing the plasma current.

(Repair of a Nick in the Partition Wall)

When a partition wall formed by the thermal spraying technique as described above has a nick for some reason, the nick can be repaired as described below with reference to FIGS. 16(*a*) through 16(*d*).

Figure 16:
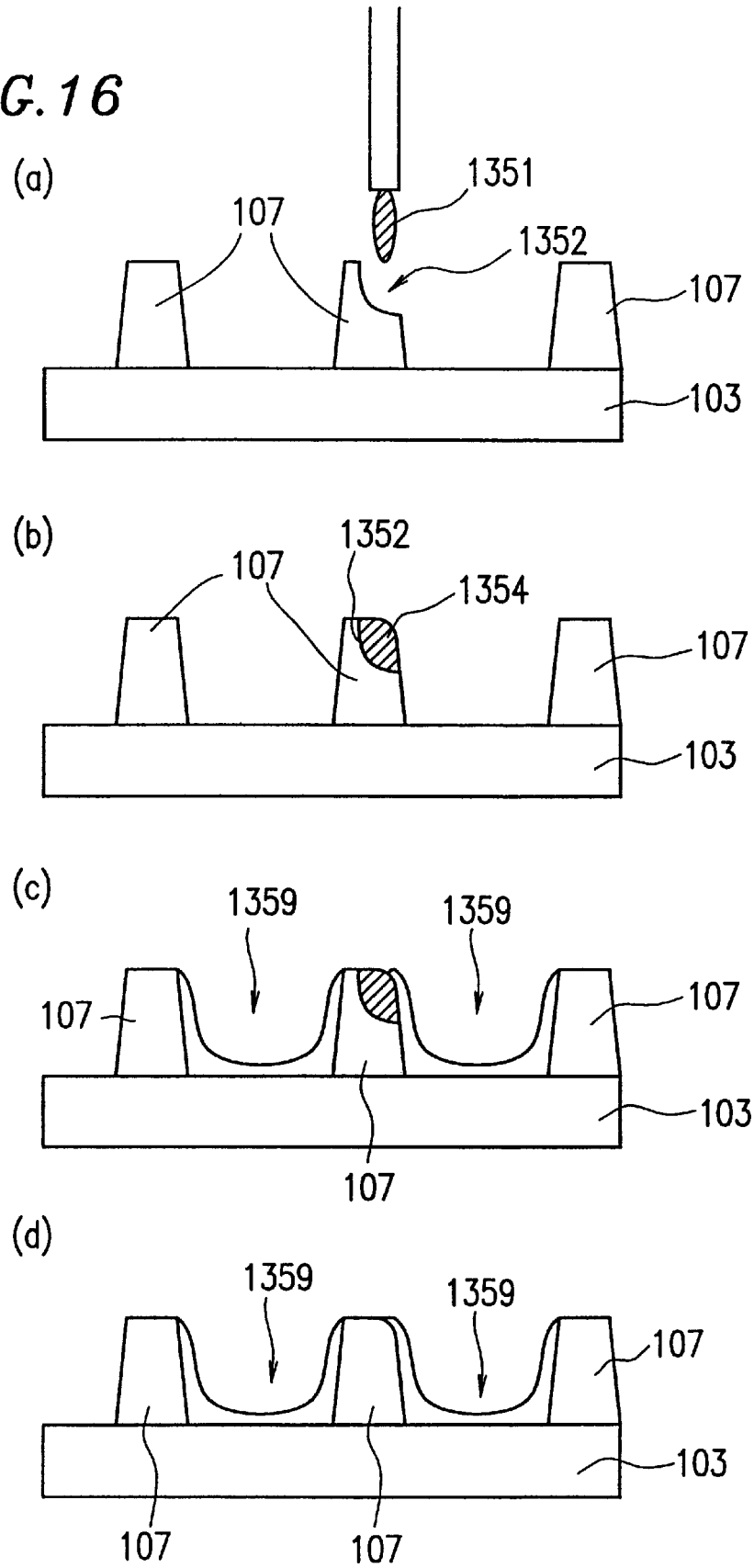
FIGS. 16(*a*) through 16(*d*) are views schematically illustrating steps of a process for repairing a nick in a partition wall formed by a thermal spraying technique.

When a part of the partition wall 107 on the substrate 103 has a nick 1352 as shown in FIG. 16(*a*), a paste 1351 is dropped onto the nick 1352. For the paste 1351, a paste material which is cured by baking of the fluorescent portion subsequently performed is preferably selected. For example, a paste material having a baking temperature similar to the baking temperature used in the baking of the fluorescent portion subsequently performed is used.

Next, the resultant laminate is dried at room temperature, thereby filling the nick 1352 of the partition wall 107 with the paste 1354 which has been dropped as shown in FIG. 16(*b*).

Then, as shown in FIG. 16(*c*), a fluorescent layer 1359 is formed by, for example, a printing technique or a line jetting technique. After that, the fluorescent layer 1359 is baked at a temperature of, for example, 540° C. By the baking, the paste 1354 filling the nick 1352 of the partition wall 107 is also baked. Thus, the nick in the partition wall 107 is repaired as schematically shown in FIG. 16(*d*).

In the above description, only the partition wall in the plasma display panel is formed by the thermal spraying technique (plasma thermal spraying technique). The address electrode and the underlying layer of the partition wall can also be formed by the thermal spraying technique. Such a procedure will be described with reference to FIGS. 17(*a*) through 17(*d*).

Figure 17:
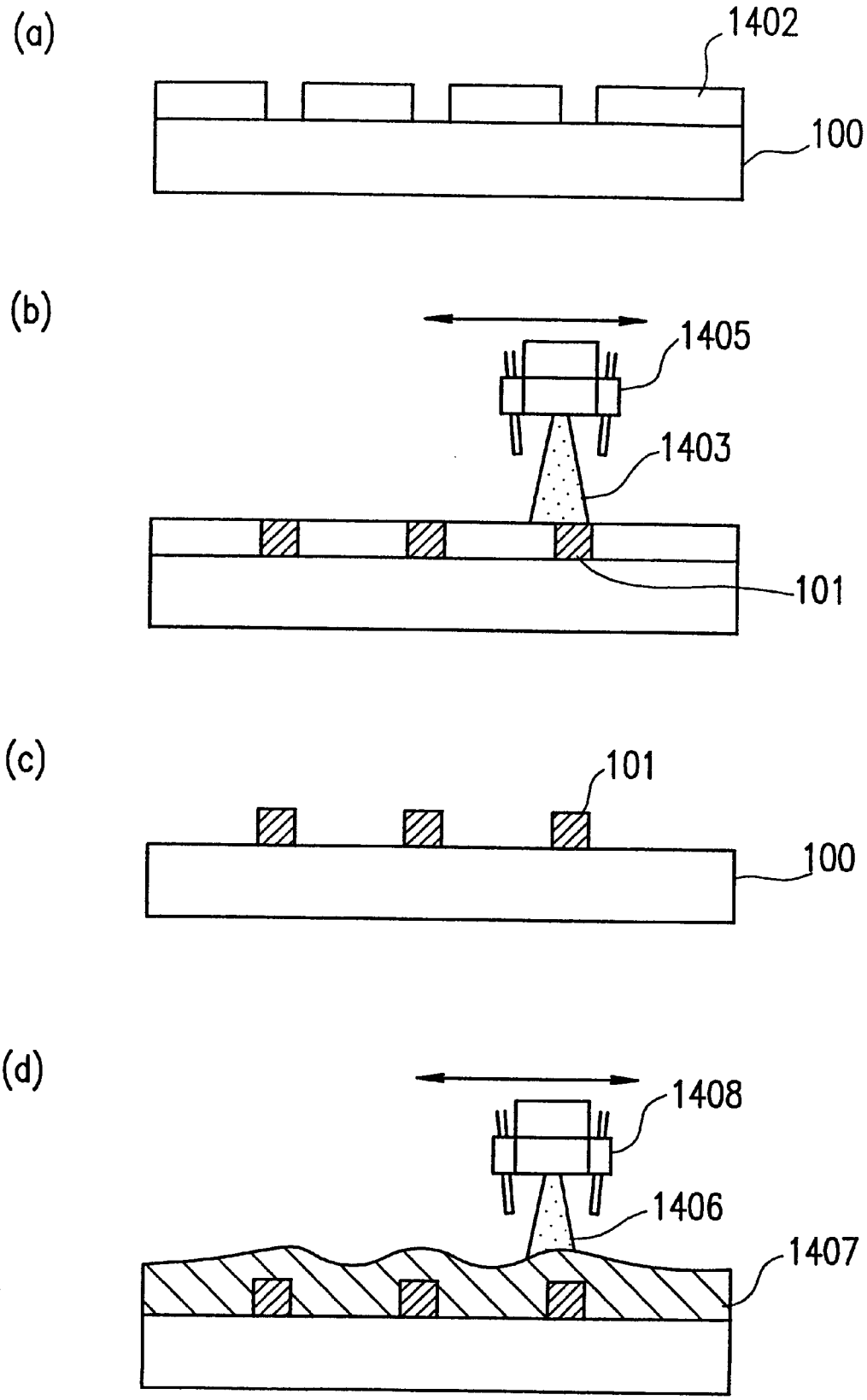
FIGS. 17(*a*) through 17(*d*) are views schematically illustrating steps of a process for forming address electrodes and an underlying dielectric film by a thermal spraying technique.

First, as shown in FIG. 17(*a*), a DFR 1402 having a prescribed thickness (for example, 20 μm) is formed on the substrate 100, and a prescribed groove pattern (for example, having an opening width of 80 μm) is formed by exposure and development.

Then, as shown in FIG. 17(*b*), a metal material 1403 is thermal-sprayed from a thermal spraying torch 1405 and thus is deposited in the groove in the DFR 1402, thereby forming the address electrodes 101. As the metal material 1403, powdered aluminum having an average particle diameter of 10 μm is, for example, used. As the plasma operating gas, argon (supplied in an amount of 10 liters/min.) is used. The plasma current is 500 A.

The thermal spraying torch 1405 used for thermal-spraying the metal material 1403 preferably has a powdered metal (thermal spray material) supply section provided outside the thermal spraying torch 1405, for the following reason. Since the melting point of the metal material is low, in the case where the powdered metal (thermal spray material) supply section is provided inside the thermal spraying torch, a spitting phenomenon occurs, i.e., the metal material adheres to an inner wall of the thermal spraying torch 1405 (for example., the inner wall of the supply section). As a result, satisfactory thermal spraying cannot be performed.

Next, the DFR is removed using, for example, an amine-based organic alkaline liquid having a liquid temperature of 40° C. as a removing liquid, thereby leaving only the address electrodes (metal electrodes) 101 on the substrate 100 as shown in FIG. 17(*c*).

Then, an insulating material 1406 is thermal-sprayed from a thermal spraying torch 1408, thereby forming an underlying dielectric layer 1407 covering the address electrodes (metal electrodes) 101 on the substrate 100. As the insulating material 1406, powdered alumina having a particle diameter distribution of 5 μm to 15 μm is, for example, used. The thickness of the underlying dielectric layer 1407 is, for example, 30 μm. The thermal spraying torch 1408 used for thermal-spraying the insulating material 1406 preferably has a thermal spraying supply section provided therein in order to allow the insulating material 1406 having a high melting point to be sufficiently melted.

In the above description, the underlying dielectric layer 1407 having a prescribed thickness is formed only by thermal spraying. Alternatively, the thickness of the underlying dielectric layer 1407 formed by thermal spraying can be adjusted by polishing a surface thereof.

After the address electrode 101 and the underlying dielectric layer 1407 are formed by the thermal spraying technique as described above, a partition wall having a prescribed shape is formed by thermal spraying in accordance with a process described above with reference to FIGS. 3(*b*) through 3(*g*).

When the partition wall and the underlying dielectric layer are formed of an identical material, the adhesiveness therebetween is improved. When the address electrode, the underlying dielectric layer and the partition wall are all formed by the thermal spraying technique, baking can be eliminated and thus use of a baking oven which consumes a great amount of electric energy is eliminated. Accordingly, the energy consumption, production cost, and production time can be reduced. Moreover, since the address electrode, the underlying dielectric layer and the partition wall can be formed by a thermal spray material not containing lead, unlike a paste required for baking, the production of the partition wall is highly compatible with environment.

Figure 18:
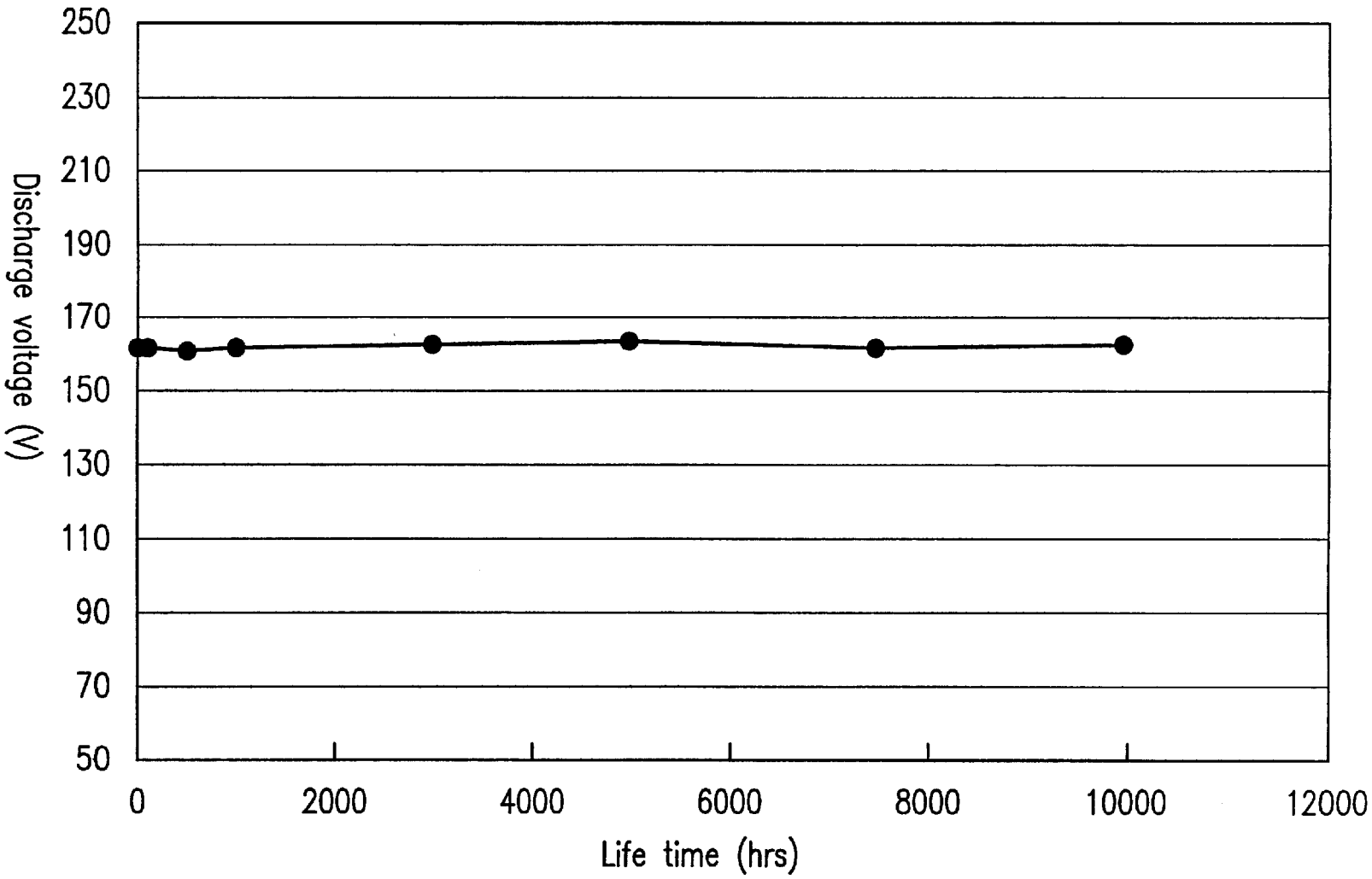
FIG. 18 is a graph illustrating an over-time change in the discharge voltage when a plasma display panel having a partition wall formed in accordance with the present invention is continuously lit up.

FIG. 18 is a graph illustrating an over-time change in the discharge voltage when a plasma display panel having a partition wall formed in accordance with the present invention is continuously lit up. As can be appreciated, the plasma display panel having a partition wall formed in accordance with the present invention provides a stable discharge voltage for a long period of time when being continuously lit up.

In the above description, a photosensitive dry film resist (DFR) is used for the photosensitive coating layer. Alternatively, other materials are usable. For example, a photosensitive liquid material can be applied using a spinner to form a photosensitive coating layer.

In the above description of the present invention, the plasma thermal spraying technique is used as an exemplary thermal spraying technique. The same effects are achieved by using other types of thermal spraying techniques which provide a similar thermal spraying procedure.

Industrial Applicability

According to the present invention, as described above, a partition wall of a plasma display panel is formed by the thermal spraying technique and thus without using baking. Moreover, since a partition wall having a large area with no nicks can be formed, a high quality plasma display panel can be provided at low cost.

What is claimed is:

1. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the partition wall has a multiple-layer structure including at least a first layer formed by depositing a first partition wall material at a plasma energy quantity A and a second layer formed by depositing a second partition wall material on the first layer to a prescribed height at a plasma energy quantity smaller than the plasma energy quantity A, where A is the plasma energy quantity at the time of thermal spraying in an area where at least thermal spray particles tightly adhere to the substrate.

2. A method for producing a plasma display panel, comprising a partition wall formation process of forming a partition wall defining a discharge space of a thermal-sprayed film formed by thermal spraying of a partition wall material, wherein the thermal spraying is plasma thermal spraying which is performed using at least argon gas or a mixture gas of argon gas and helium gas as plasma operating gas, and the plasma operating gas is the mixture gas of argon gas and helium gas, and the plasma energy quantity is changed by changing the amount of helium gas.

3. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, and wherein, where the width of the top end of the opening having the prescribed pattern formed on the photosensitive coating layer is Wa, a primary particle diameter D of powder of the partition wall material is in the range of 5 mm or more and 0.7·Wa or less.

4. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the step of forming the thermal-sprayed film includes the step of removing thermal spray particles adhering to the photosensitive coating layer simultaneously with the deposition of the partition wall material.

5. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the step of forming the thermal-sprayed film includes the step of heating the substrate from a rear surface thereof to maintain a temperature distribution in the substrate within a prescribed range.

6. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the step of forming the thermal-sprayed film includes the step of cooling a surface of the substrate to maintain a temperature distribution in the substrate within a prescribed range.

7. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the step of forming the thermal-sprayed film includes the step of heating the substrate from a rear surface thereof and cooling a surface of the substrate to maintain a temperature distribution in the substrate within a prescribed range.

8. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing; and removing the photosensitive coating layer to obtain the partition wall having a prescribed shape, wherein the step of polishing includes the step of removing the photosensitive coating layer from the surface thereof to a depth of about 10 mm.

9. A method for producing a plasma display panel, comprising a partition wall formation process of forming a partition wall defining a discharge space of a thermal-sprayed film formed by thermal spraying of a partition wall material, wherein the partition wall formation process includes the steps of:

forming a photosensitive coating layer on a substrate;

forming an opening having a prescribed pattern in the photosensitive coating layer;

depositing the partition wall material to a prescribed height at least inside the opening by the thermal spraying technique, thereby forming the thermal-sprayed film;

removing a portion of the thermal-sprayed film bulging out from a surface of the photosensitive coating layer by polishing;

removing the photosensitive coating layer to obtain the partition wall having a prescribed shape, filling a nick in the partition wall with a prescribed paste material; and forming a fluorescent layer by baking after the photosensitive coating layer is removed, wherein the prescribed paste material is cured by baking of the fluorescent layer.

* * * * *